US006848775B2

(12) United States Patent
Ishizawa et al.

(10) Patent No.: US 6,848,775 B2
(45) Date of Patent: Feb. 1, 2005

(54) INK CARTRIDGE FOR RECORDING APPARATUS

(75) Inventors: Taku Ishizawa, Nagano (JP); Masanori Kamijyo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/832,180

(22) Filed: Apr. 11, 2001

(65) Prior Publication Data

US 2001/0038405 A1 Nov. 8, 2001

(30) Foreign Application Priority Data

Apr. 11, 2000 (JP) ..... P.2000-109502
May 23, 2000 (JP) ..... P.2000-150925
May 23, 2000 (JP) ..... P.2000-150926

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 3,074,104 A 1/1963 Stanley
4,760,409 A * 7/1988 Kiyohara et al. ..... 347/85
5,221,935 A * 6/1993 Uzita ..... 347/86
5,325,119 A 6/1994 Fong
5,666,146 A * 9/1997 Mochizuki et al. ..... 347/86
6,030,074 A * 2/2000 Barinaga ..... 347/85
6,099,115 A * 8/2000 Faoro ..... 347/86
6,158,853 A * 12/2000 Olsen et al. ..... 347/86

FOREIGN PATENT DOCUMENTS

EP 0 583 154 A2 2/1994
JP 59204566 * 11/1984 ..... 347/78
JP 07-52399 2/1995
WO WO 87 04089 7/1987

OTHER PUBLICATIONS

Patent Abstracts of Japan vol. 010, No. 216 Jul. 29, 1986 & JP 61 054942 A (Konishiroku Photo Ind. Co., Ltd), Mar. 19, 1986 abstract.
Patent Abstracts of Japan vol. 010, No. 360 Dec. 3, 1986 & JP 61 158460 A (Konishiroku Photo Ind. Co., Ltd.) Jul. 18, 1986 abstract.

* cited by examiner

*Primary Examiner*—Anh T. N. Vo
(74) *Attorney, Agent, or Firm*—Sughrue Mion, PLLC

(57) ABSTRACT

An ink cartridge is constituted of an ink-filled bag-shaped ink pack and an outer shell case for housing the ink pack. An ink cartridge according to one embodiment is constituted such that a contact prevention member is housed in the ink pack for preventing close contact between interior surfaces of the ink pack when a reduction arises in the amount of ink stored in the ink pack.

31 Claims, 17 Drawing Sheets

INK CARTRIDGE FOR RECORDING APPARATUS

BACKGROUND OF THE INVENTION

1. Field of the Invention

The present invention relates to an ink cartridge for an ink-jet recording apparatus, having an ink pack that is formed of flexible material into a flat bag shape, and that is stored in a case forming an outer shell of the cartridge.

2. Description of the Related Art

In general, an ink-jet recording apparatus is equipped with an ink-jet recording head which is mounted on a carriage and moved in the widthwise direction of recording paper, and paper feed system for moving the recording paper in the direction orthogonal to the traveling direction of the recording head. On the basis of print data, ink droplets are ejected from the recording head, thus recording the data on the recording paper.

In order to effect a comparatively-high volume of printing, a recording apparatus of this type supplied for, for example, an office or business purpose, requires use of high-volume ink cartridges. To this end, there has been provided a recording apparatus, in which ink cartridges are fitted to a cartridge holder provided, for example, to an apparatus main body.

In the recording apparatus, for example, sub-tanks are disposed on the carriage having the recording head, and the respective sub-tanks are replenished with ink from corresponding ink cartridges by way of ink supply tubes. The sub-tanks, in turn, supply ink to the recording head.

Recently, growing demand exists for a large-size recording apparatus capable of effecting printing on larger-size paper, in which a carriage travels a longer scan distance. In order to improve throughput of such a recording apparatus, a larger number of nozzles are provided in a recording head.

Further, demand exists for a recording apparatus which sequentially supplies ink to the respective sub-tanks mounted on the carriage from corresponding ink cartridges while performing printing operation, in order to improve throughput, and which stably supplies ink from the respective sub-tanks to the recording head.

In such a recording apparatus, since the ink supply tubes are required to connect the ink cartridges to the sub-tanks corresponding to the types of ink, and since the carriage travels over a longer scan distance, the lengths of respective ink supply tubes inevitably increase.

Further, as mentioned above, a larger number of nozzles are provided in the recording head. Hence, such a recording apparatus encounters a technical problem of deficient ink supply to the sub-tanks because the recording head consumes a large quantity of ink, and an increase in the dynamic pressure (i.e., pressure loss) of ink is likely to occur within each of the ink supply tubes interconnecting the ink cartridges and the sub-tanks.

As one measure to prevent this technical problem, there may be employed, for example, a construction in which air pressure is applied to the ink cartridges to forcibly induce ink flows from the ink cartridges to the sub-tanks under air pressure. This construction makes it possible to supply a sufficient amount of ink to the sub-tanks.

Preferably, an ink cartridge to be used in the recording apparatus having the foregoing construction includes a hermitically sealed case constituting an outer shell, and an ink pack which is formed by flexible material, which stores ink therein and which is accommodated in the case.

The ink pack in the ink cartridge of such a construction is depressed under pressurized air applied to the inside of the case to discharge and supply ink toward the recording head mounted on the carriage.

In this case, the ink filled in the ink pack is diminished in the vicinity of the outlet port of the ink pack. In a case where the amount of remaining ink has become smaller, the center portions of the ink pack, for example, come into close contact with each other to hinder ink flow.

Accordingly, residual ink cannot reach the area in the vicinity of the ink outlet port of the ink pack. That is, the ink cartridge becomes unusable while a considerable amount of ink still remains in the ink pack.

Consequently, the user is required to bear higher operating costs in the long term. Further, even at the time of disposal of a cartridge, the load such as treatment of the residual ink or the like is required.

Such a phenomenon is likely to arise particularly in a construction in which an ink pack is pressurized by the pressurized air applied into a case of the ink cartridge.

SUMMARY OF THE INVENTION

The present invention has been conceived to solve such technical drawbacks. Particularly, the present invention is aimed at providing an ink cartridge which is adapted for use with an ink-jet recording apparatus designed to pressurize an ink pack by pressurized air applied to the inside of a cartridge case, and which can improve the efficiency of use of ink filled in the ink pack.

Further, the present invention is aimed at providing an ink cartridge which is adapted for use with an ink-jet recording apparatus designed to pressurize an ink pack by pressurized air applied to a case, and mount the flattened ink pack to orient the surfaces thereof, in particular, in substantially a vertical state, and which can improve the efficiency of use of ink filled in the ink pack.

Furthermore, the present invention is aimed at providing an ink cartridge which is adapted for use with an ink-jet recording apparatus designed to pressurize an ink pack by pressurized air applied to a case, and to mount the flattened ink pack to orient surfaces thereof, in particular, in substantially a horizontal state, and which can improve the efficiency of use of ink filled in the ink pack.

To achieve these objectives, an ink cartridge for use with a recording apparatus according to a first aspect of the present invention, comprising:

- an ink pack which is filled with ink and is formed into a flattened bag shape from flexible material;
- a case housing the ink pack and constituting an outer shell of the cartridge; and
- a contact prevention member which is provided within the ink pack for preventing close contact between interior surfaces of the ink pack, caused by a reduction in the amount of ink stored, thereby ensuring an ink flow passage.

Preferably, the ink cartridge is constructed such that the case is hermetically formed, and air pressure can be applied from a recording apparatus to the interior of the case to pressurize the ink pack when the ink cartridge is loaded to the recording apparatus.

In addition, it is desirable that the contact prevention member for preventing close contact between interior surfaces of the ink pack, caused by a reduction in the amount of ink stored, be formed from genuine material.

Preferably, the ink cartridge is loaded to the recording apparatus such that surfaces of the flattened ink pack are oriented in a vertical direction, and the contact prevention member for preventing close contact between interior surfaces of the ink pack is located in a lower position with respect to the direction of gravity.

Preferably, the contact prevention member is formed from a single rod member. Further, it is desirable that the contact prevention member formed from the single rod member be fixed on one interior surface of flexible material constituting the ink pack, by heat welding.

Preferably, the contact prevention member is formed by bending a single rod member into a substantially-rectangular shape, and arranging the rod member along four sides of the flattened ink pack.

In the ink cartridge of the first aspect embodied as mentioned above, pressurized air is introduced into the case when the ink cartridge is loaded to the recording apparatus, and the ink filled in the ink pack is let outside when the ink pack receives the pressurized air. In this case, the contact prevention member formed from genuine material for preventing close contact between the interior surfaces of the ink pack is housed within the ink pack, the presence of the contact prevention member prevents a problem of, for example, clogging in the center portions of the ink pack, which would otherwise be caused when the center portions are brought into close contact with each other as a result of pressurized air acting on the ink pack.

A void is formed in the area of the ink pack where the contact prevention member is housed, and remaining ink is guided to an outlet port by way of an ink flow passage formed by the void.

Genuine material: for example, a metal rod member or a so-called wire, can be utilized as the contact prevention member. Hence, the amount of ink remaining in the ink pack can be reduced to as small amount as possible, thus improving the efficiency of use of ink stored in the ink pack.

In a case where the ink cartridge is loaded to the recording apparatus such that surfaces of the flattened ink pack are oriented in a vertical direction, the contact prevention member for preventing close contact between interior surfaces of the ink pack is located at least partially in a lower position with respect to the direction of gravity within the ink pack, whereby the ink remaining in the ink pack gathers around the area in the vicinity of the contact prevention member under gravity.

The residual ink that has gathered around the area in the vicinity of the contact prevention member is guided to the outlet port by way of the ink flow passage formed by the contact prevention member, thus contributing to the efficiency of use of the ink stored in the ink cartridge.

In this case, the contact prevention member formed from a single rod member sufficiently operates, thus effecting substantially no influence on costs for manufacturing ink cartridges.

The contact prevention member is formed from a single rod member and into a substantially-rectangular shape. When the rectangular contact prevention member is housed along four sides of the ink pack, there is eliminated a necessity of managing the front and reverse sides of the ink pack during the course of housing the ink pack into the ink cartridge. In the same manner as mentioned previously, ink remaining in the ink pack can gather in the vicinity of the contact prevention member under gravity.

An ink cartridge for use with a recording apparatus according to a second aspect of the present invention, comprising:

an ink pack which is filled with ink and is formed into a flattened bag shape from flexible material; and a case housing the ink pack and constituting an outer shell of the cartridge;

wherein the ink cartridge is loaded to the recording apparatus such that surfaces of the flattened ink pack are oriented in a substantially vertical state, and wherein an ink flow passage bulging outwardly of the ink pack is formed on at least one of interior surfaces of flexible material constituting the ink pack to extend along a gravity direction lower side of the ink pack.

Preferably, the ink flow passage is formed by press-forming flexible material constituting the ink pack. Preferably, the ink flow passage formed along the gravity direction lower side of the ink pack is elongated to reach the vicinity of the ink outlet port.

Preferably, the ink cartridge is formed such that the case is formed hermetically, and air pressure can be applied from a recording apparatus to the interior of the case to pressurize the ink pack when the ink cartridge is loaded to the recording apparatus.

In the ink cartridge of the second aspect embodied as mentioned above, the ink cartridge is loaded to the recording apparatus such that surfaces of a flattened ink pack are oriented in a vertical direction, and an ink flow passage bulging outwardly of the ink pack is formed on at least one of interior surfaces of flexible material constituting the ink pack to extend along the gravity direction lower side of the ink pack. Hence, when the amount of ink stored in the ink pack becomes small, the ink remaining in the ink pack gathers along and into the ink flow passage formed by the action of gravity.

The ink gathering in the vicinity of the ink flow passage is guided to the outlet port by way of the ink flow passage, thus improving the efficiency of use of ink stored in the ink cartridge.

In this case, if the ink flow passage formed along the gravity direction lower side of the ink pack is extended to reach the vicinity of the ink outlet port disposed on an end of the ink pack, guiding effect of residual ink to the ink outlet port can be promoted, thus contributing to an improvement in the efficiency of use of the ink stored in the ink cartridge.

To achieve this, the ink flow passage bulging outwardly and formed on at least one of interior surfaces of flexible material constituting the ink pack can be readily formed, by press-forming flexible material constituting the ink pack. Consequently, no substantial influence is exerted on costs for manufacturing an ink cartridge.

In a case where the foregoing construction is applied to an ink cartridge such that pressurized air is introduced into a case when the ink cartridge is loaded to the recording apparatus and such that the ink sealed in the ink pack is let out when the ink pack receives pressurized air, there can be prevented a problem of, for example, clogging in the center portions of the ink pack, which would otherwise be caused when the center portions are brought into close contact with each other as a result of the pressurized air acting on the ink pack.

An ink cartridge for use with a recording apparatus according to a third aspect of the present invention, comprising:

an ink pack which is filled with ink and is formed into a flattened bag shape from flexible material; and a case housing the ink pack and constituting an outer shell of the cartridge;

wherein the ink cartridge is loaded to the recording apparatus such that surfaces of the flattened ink pack are oriented in a substantially horizontal state, and wherein ink flow passages bulging outwardly of the ink pack are formed on at least one of interior surfaces of flexible material constituting the ink pack to extend along respective sides of the ink pack perpendicular to the side in which the ink outlet port is formed.

Preferably, the ink flow passages are formed by press-forming flexible material constituting the ink pack.

Preferably, an ink outlet side end of each ink flow passage formed along the respective side of the ink pack is extended to reach the vicinity of the ink outlet port.

Preferably, the ink cartridge is formed such that the case is formed hermetically, and air pressure can be applied from a recording apparatus to the inside of the case to pressurize the ink pack when the ink cartridge is loaded to the recording apparatus.

In the ink cartridge of the third aspect embodied as mentioned above, the ink cartridge is loaded to the recording apparatus such that surfaces of a flattened ink pack are oriented in a horizontal direction, and ink flow passages bulging outwardly are formed on at least one of interior surfaces of flexible material constituting the ink pack to extend along respective sides of the ink pack perpendicular to the side in which the ink outlet port is formed. Hence, when the amount of ink stored in the ink pack becomes small, the ink remaining in the ink pack gathers into and along the ink flow passages formed along the respective side edges of the ink pack.

The ink remaining in the vicinity of the ink flow passages is guided to the outlet port by way of the ink flow passages, thus improving the efficiency of use of ink stored in the ink cartridge.

In this case, if the ink outlet side end of each ink flow passage formed along the respective side of the ink pack is extended to reach the vicinity of the ink outlet port, the guiding effect of residual ink to the ink outlet port can be promoted, thus contributing to an improvement in the efficiency of use of the ink stored in the ink cartridge.

To achieve this, the ink flow passages bulging outwardly and formed on at least one of interior surfaces of flexible material constituting the ink pack can be readily formed, by press-forming flexible material constituting the ink pack. Consequently, no substantial influence is exerted on costs for manufacturing an ink cartridge.

In a case where the foregoing construction is applied to an ink cartridge such that pressurized air is introduced into a case when the ink cartridge is loaded to the recording apparatus and such that the ink sealed in the ink pack is let out when the ink pack receives pressurized air, there can be prevented a problem of, for example, clogging in the center portions of the ink pack, which would otherwise be caused when the center portions are brought into close contact with each other as a result of the pressurized air acting on the ink pack.

The present disclosure relates to the subject matter contained in Japanese patent application Nos.

2000-109502 (filed on Apr. 11, 2000), 2000-150926 (filed on May 23, 2000), and 2000-150925 (filed on May 23, 2000), which are expressly incorporated herein by reference in their entireties.

DESCRIPTION OF THE PREFERRED EMBODIMENT

Hereafter, an ink cartridge for a recording apparatus, according to first, second and/or third aspect of the present invention, will be discussed with reference to illustrated embodiments.

Ink-Jet Recording Apparatus

Figure 1A:
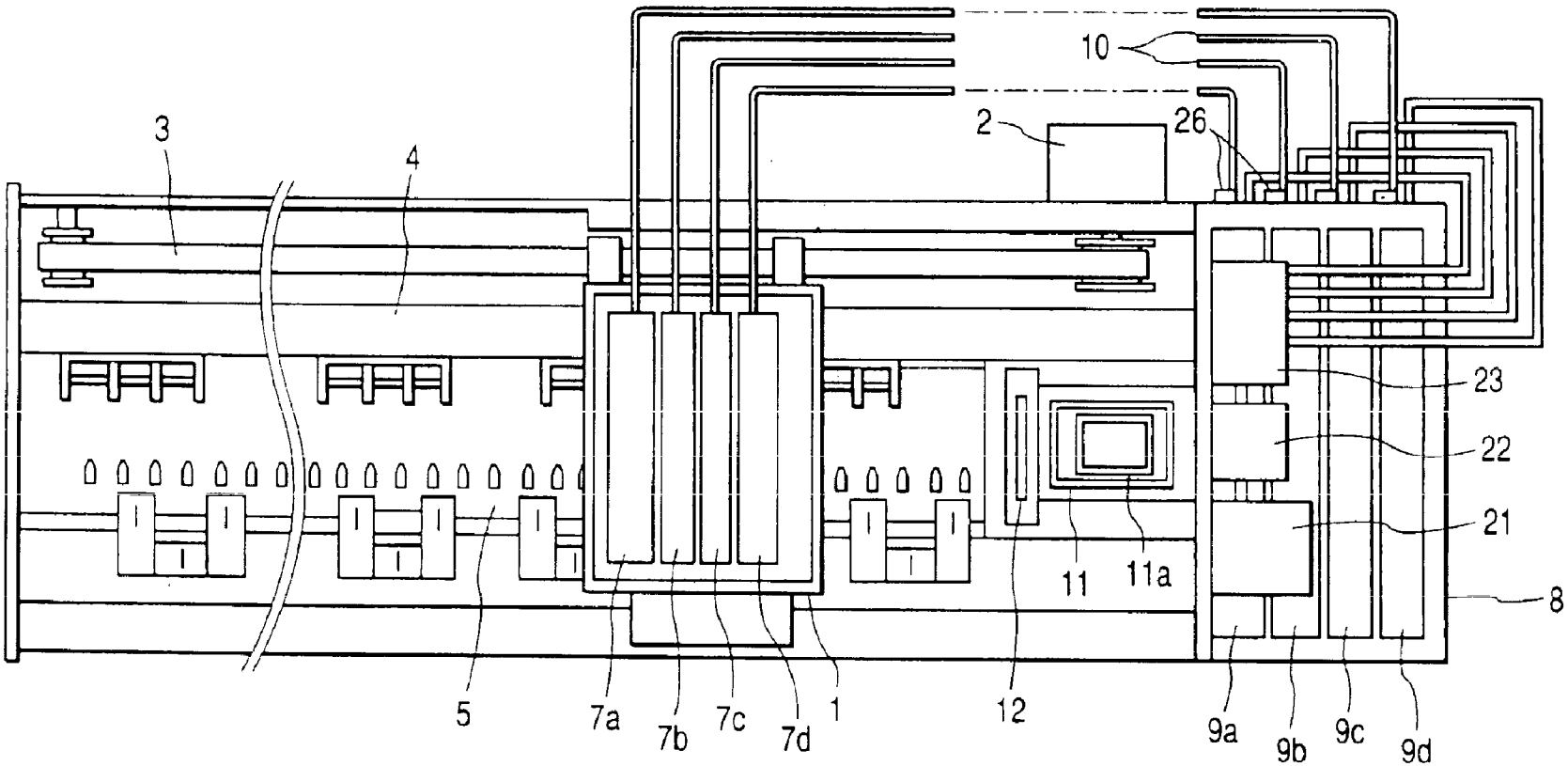
FIG. 1A is a top view of an example of an ink-jet recording apparatus with which an ink cartridge according to a first aspect of the present invention can be used.

FIG. 1 is a top view showing an example of an ink-jet recording apparatus capable of using an ink cartridge constructed according to, for example, a first aspect of the present invention. As shown in FIG. 1A, reference numeral 1 designates a carriage. The carriage 1 is constructed so as to cause reciprocating movement in the longitudinal direction of a paper feed member 5; that is, in the primary scanning direction identical with the widthwise direction of recording paper, while being guided by a scan guide member 4 by way of a timing belt 3 driven by a carriage motor 2.

Although not shown in FIG. 1A, an ink-jet recording head 6 to be described later is mounted on the surface of the carriage 1, which surface opposes the paper feed member 5.

Sub-tanks 7*a* through 7*d* for supplying ink to the recording head are mounted on the carriage 1. In the present embodiment, four sub-tanks 7*a* through 7*d* are provided so as to correspond to the types of ink and to temporarily store the ink therein.

The sub-tanks 7*a* through 7*d* are constructed such that, for example, black ink, yellow ink, magenta ink, and cyan ink are supplied to the sub-tanks 7*a* through 7*d* from corresponding main tanks 9*a* through 9*d* through flexible ink supply tubes 10, respectively. The main tanks 9*a* through 9*d*, i.e. ink cartridges, are attached to a cartridge holder 8 provided on the apparatus main body of the recording apparatus.

As described in detail later, each of the main tanks 9*a* through 9*d* serving as the ink cartridges has a rectangular and flattened outer shell configuration, and, in case of the recording apparatus embodiment shown in FIG. 1A, is attached to the cartridge holder 8 in such a vertical state that the flattened surface direction of the cartridge is oriented in a perpendicular direction.

Capping system 11 capable of sealing a nozzle-formed plane of the recording head is disposed in a non-print region (i.e., at the home position) on the travel path of the carriage 1. A cap member 11*a* which is formed from flexible material, such as rubber, that is capable of sealing a nozzle-formed plane of the recording head is attached to the upper surface of the capping system 11.

The cap member 11*a* is designed to seal the nozzle-formed plane of the recording head when the carriage 1 is moved to the home position.

During the non-operating period of the recording apparatus, the cap member 11*a* seals the nozzle-formed plane of the recording head, thereby acting as a cover for preventing drying of nozzle orifices. Although not depicted, one end of a tube of a suction pump (i.e., a tube pump) is connected to the cap member 11*a*, so that negative pressure generated by the suction pump is applied to the recording head, to thereby perform a cleaning operation for causing the recording head to discharge ink under suction.

A wiping member 12 formed from resilient material, such as rubber, is disposed adjacent to the capping system 11 and in a print region side with respect to the capping system 11 so as to wipe and clean the nozzle-formed plane of the recording head as required.

Figure 1B:
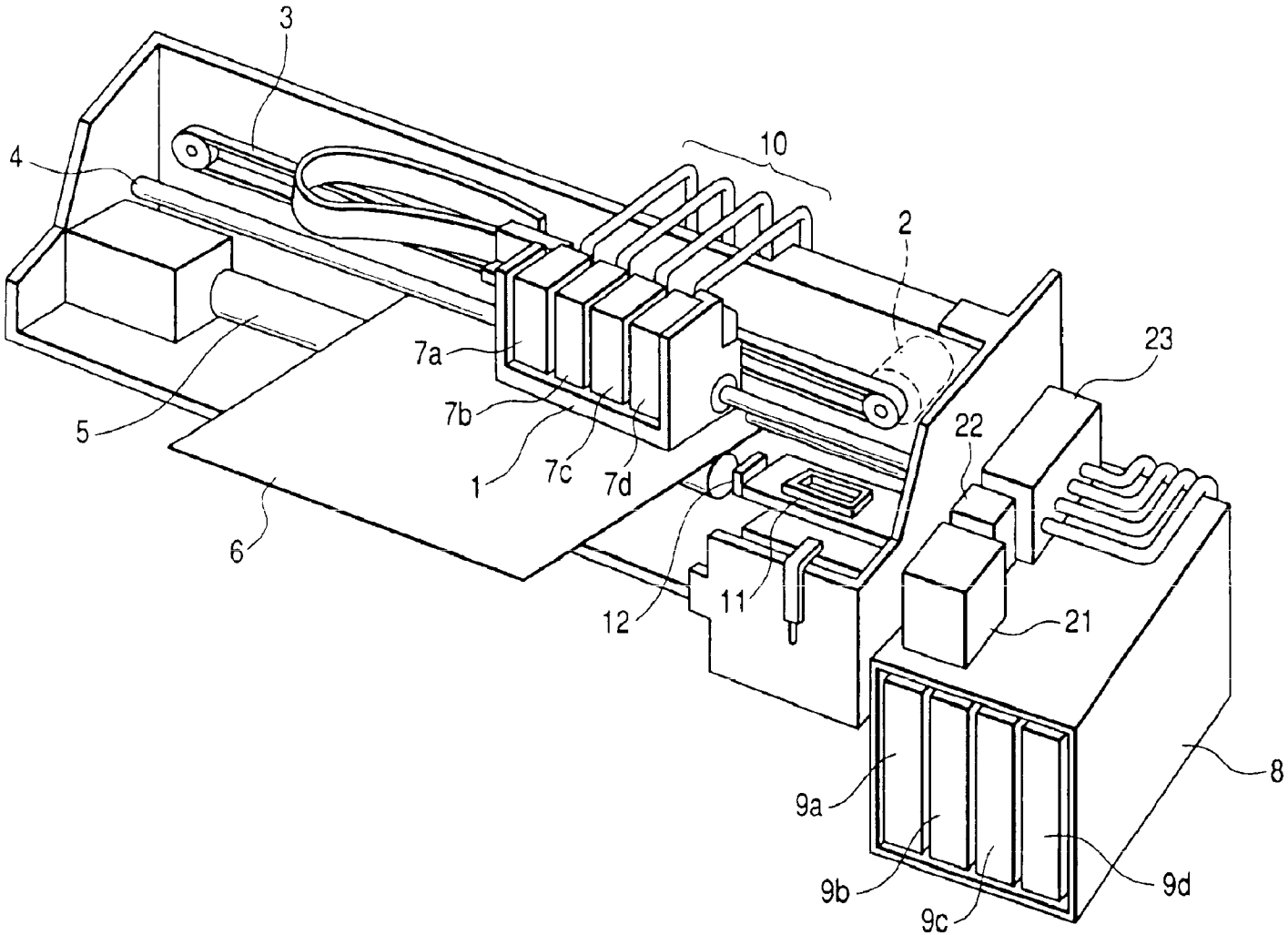
FIG. 1B is a perspective view of an example of an ink-jet recording apparatus with which an ink cartridge according to a second aspect of the present invention can be used.

FIG. 1B is a perspective view showing an example of an ink jet type recording apparatus with which an ink cartridge according to the present invention, in particular, a second aspect of the present invention, can be suitably used. In this recording apparatus, each of ink cartridges (main tanks) 9*a* through 9*d* of flattened outer shell configurations is mounted to the cartridge holder 8 in such a longitudinally set state that the flattened surface direction of the cartridge is oriented in a vertical direction.

Figure 1C:
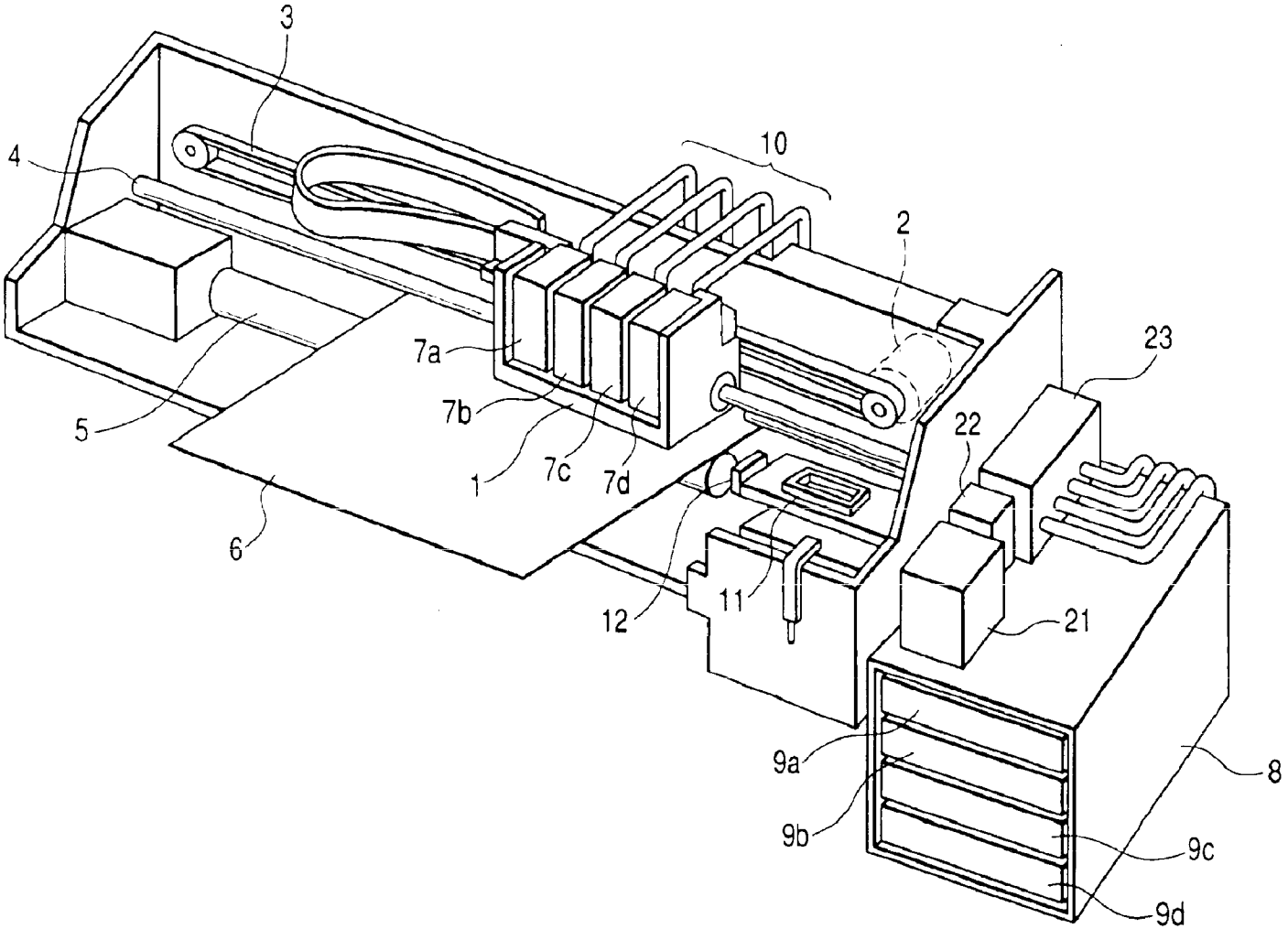
FIG. 1C is a perspective view of an example of an ink-jet recording apparatus with which an ink cartridge according to a third aspect of the present invention can be used.

FIG. 1C is a perspective view showing an example of an ink jet type recording apparatus with which an ink cartridge according to the present invention, in particular, a third aspect of the present invention can be suitably used. In this recording apparatus, each of ink cartridges (main tanks) 9*a* through 9*d* of flattened outer shell configurations is mounted to the cartridge holder 8 in such a laterally set state that a direction perpendicular to the flattened surface direction of the cartridge is oriented in a vertical direction, that is, the flattened surface direction of the cartridge is oriented in a horizontal direction.

The basic constructions of the recording apparatuses shown in FIGS. 1B and 1C are substantially the same as that of the recording apparatus shown in FIG. 1A, so that corresponding components or portions are denoted by the same reference numerals, to thereby remove repeated discussion for the components or portions of the recording apparatuses shown in FIGS. 1B and 1C.

Figure 2:
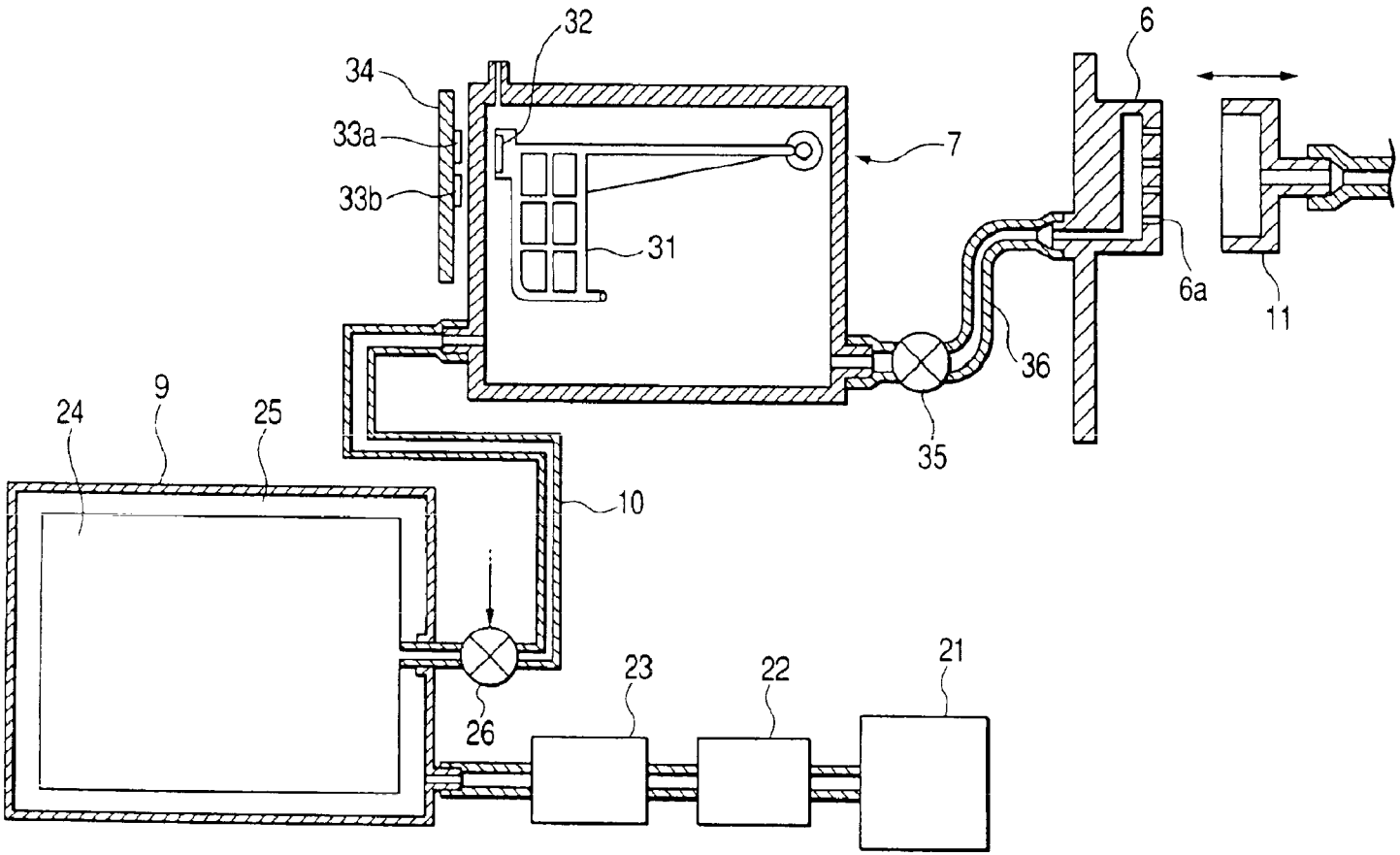
FIG. 2 is a schematic diagram showing an ink supply system which extends from an ink cartridge to a recording head of either of the recording apparatus shown in FIG. 1A through FIG. 1C.

FIG. 2 is a schematic drawing showing an ink supply system extending from an ink cartridge to a recording head in the recording apparatus shown in each of FIGS. 1A through 1C. The ink supply system will now be described by reference to FIG. 2 in conjunction with FIGS. 1A through 1C, in which like elements are assigned like reference numerals.

Referring to FIGS. 1A through 1C and 2, reference numeral 21 designates an air pressurization pump constituting a pressurization unit. The air pressurized by the air pressurization pump 21 is supplied to a pressure regulation valve 22. The pressurized air is supplied to the respective main tanks 9*a* through 9*d* (the main tanks are designated in FIG. 2 by simply reference numeral 9, and the main tanks will often be described in singular form by use of only reference numeral 9) by way of a pressure detector 23.

The pressure regulator valve 22 has the function of maintaining the air pressure applied to the respective main tanks 9*a* through 9*d* within a predetermined range by releasing pressure when the air pressurized by the air pressurization pump 21 has reached a predetermined pressure level or greater.

The pressure detector 23 operates so as to detect the air pressurized by the air pressurization pump 21 and control the operation of the air pressurization pump 21. More specifically, when having detected that the air pressurized by the air pressurization pump 21 has reached a predetermined pressure level, the pressure detector 23 stops actuation of the pressurization pump 21 on the basis of the detection result. In contrast, when having detected that the air pressure has fallen below a predetermined pressure level, the pressure detector 23 performs control operation so as to actuate the air pressurization pump 21. By repetition of these operations, the air pressure applied to the main tanks 9*a* through 9*d* is maintained within the predetermined range.

The detailed construction of the ink cartridge, i.e. the main tank 9, will be described later. As the construction of the main tank 9 is schematically shown in FIG. 2, the outer shell of the main tank 9 is formed hermetically. An ink pack 24 which is filled with ink and is formed from resilient material is housed in the main tank 9.

The space defined by combination of the main tank 9 and the ink pack 24 constitutes a pressure chamber 25, and the pressurized air is supplied to the pressure chamber 25 by way of the pressure detector 23.

With such a construction, the ink packs 24 housed in the main tanks 9*a* through 9*d* are subjected to pressure stemming from the pressurized air, whereby ink flows from the main tanks 9*a* through 9*d* to the corresponding sub-tanks 7*a* through 7*d* under predetermined pressure.

As shown in FIG. 2, the ink pressurized in each of the main tanks 9*a* through 9*d* is supplied to the corresponding one of the sub-tanks 7*a* through 7*d* mounted on the carriage 1, by way of the corresponding one of ink supply valves 26 and the corresponding one of the ink supply tubes 10 (the sub-tanks are designated in FIG. 2 by use of simply reference numeral 7, and hereinafter the sub-tanks will often be described in singular form by use of simply reference numeral 7).

As shown in FIG. 2, a float member 31 is provided within the sub-tank 7, and a permanent magnet 32 is attached to a part of the float member 31. Magnetoelectric converter elements 33*a* and 33*b* typified by Hall elements are mounted on a board 34, and the board 34 is disposed in close proximity to the side wall of the sub-tank 7.

With such an arrangement, the permanent magnet 32 provided on the float member 31 and the Hall elements 33*a* and 33*b* constitute ink level detection system. In accordance with the amount of lines of magnetic force developing in the permanent magnet 32 according to the position of the float member 31, an electrical output is produced by the Hall elements 33*a* and 33*b*.

When the level of the ink stored in the sub-tank 7 has lowered, the float member 31 housed in the sub-tank 7 is moved under the force of gravity. In association with this movement, the permanent magnet 32 is also moved in the same direction.

The electrical output produced by the Hall elements 33*a* and 33*b* in association with movement of the permanent magnet 32 can be sensed as the level of the ink stored in the sub-tank 7. On the basis of the electrical output produced by the Hall elements 33*a* and 33*b*, the ink supply valve 26 is opened. As a result, the pressurized ink in the main tank 9 is supplied to each corresponding sub-tank 7 whose ink level has lowered.

When the ink stored in the sub-tank 7 has risen to a predetermined level, the ink supply valve 26 is closed on the basis of the electrical output produced by the Hall elements 33*a* and 33*b*.

By repetition of these operations, ink is intermittently supplied from the main tank 9 to the sub-tank 7, thereby constantly storing substantially a given amount of ink within each sub-tank 7.

The sub-tank 7 is constructed such that ink is supplied from the sub-tank 7 to the recording head 6 by way of a valve 35 and a tube 36 connected thereto. On the basis of print data supplied to an unillustrated actuator of the recording head 6, ink droplets are ejected from nozzle orifices 6*a* formed in the nozzle-formed plane of the recording head 6.

Referring to FIG. 2, reference numeral 11 designates the previously-described capping system, and a tube connected to the capping system 11 is connected to an unillustrated suction pump (i.e., a tube pump).

Ink Cartridge

Figure 3:
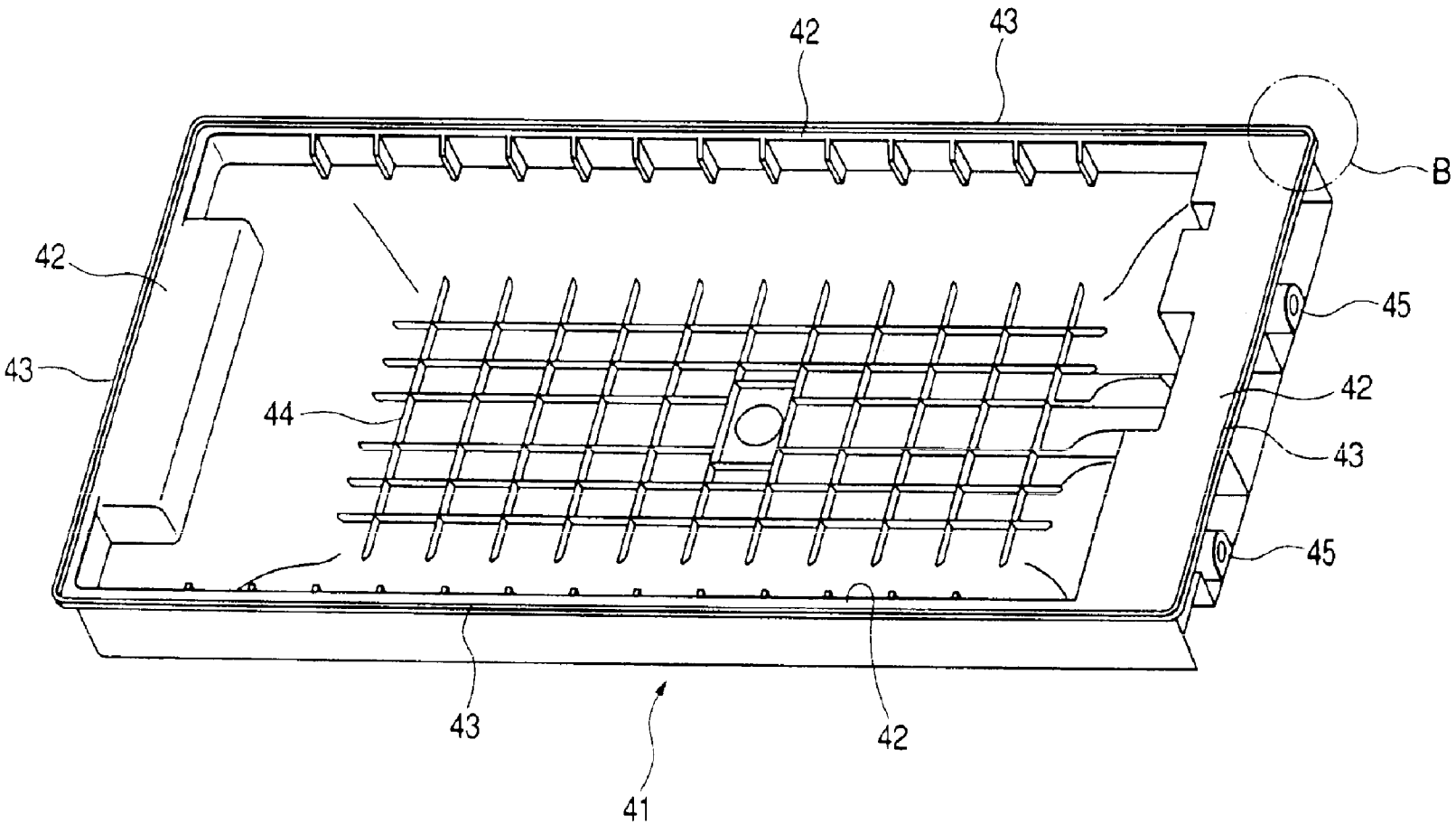
FIG. 3 is a perspective view showing the construction of a lower case constituting an outer shell of the ink cartridge according to the present invention.
Figure 4:
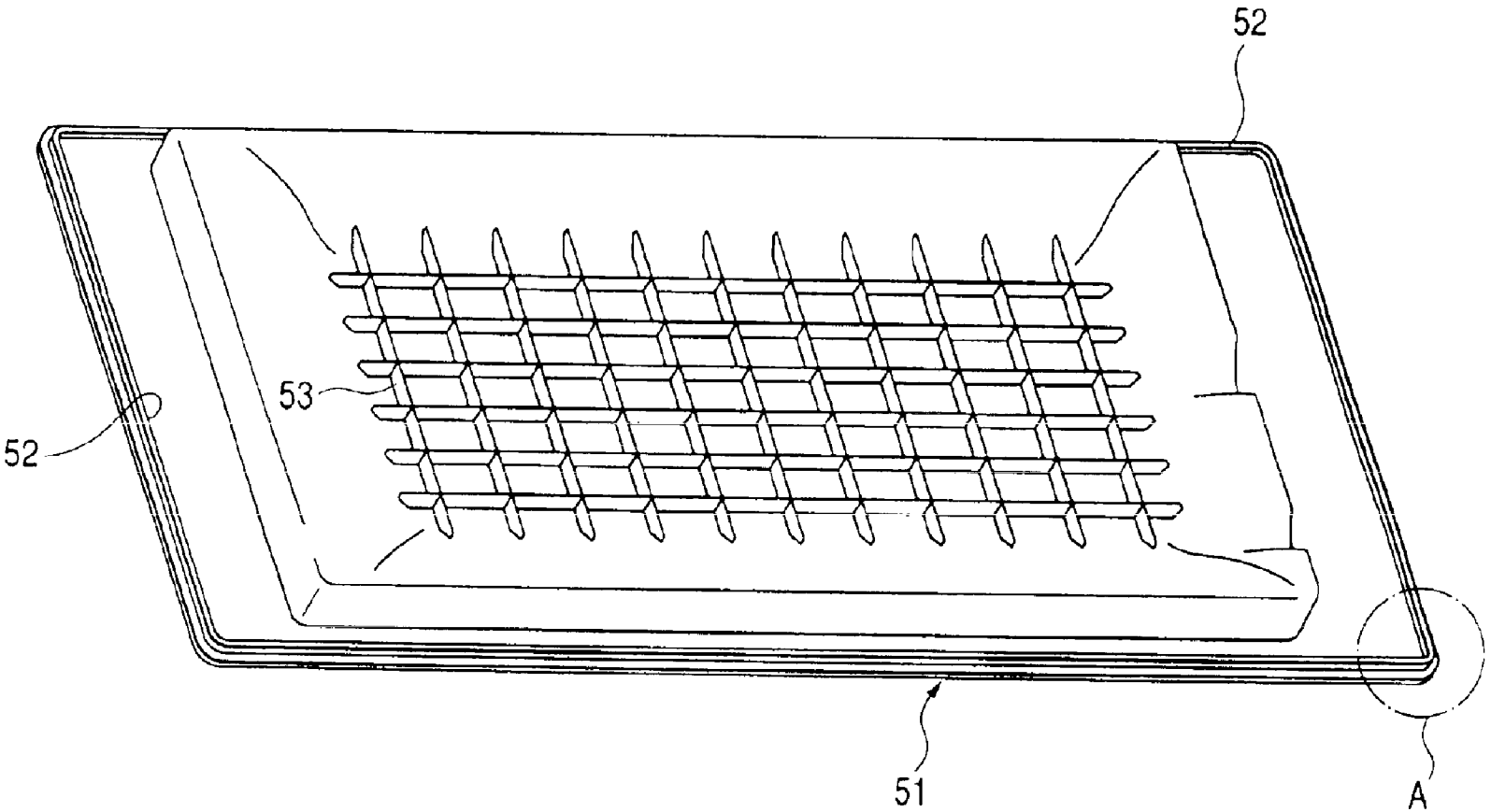
FIG. 4 is a perspective view showing the construction of an upper case constituting the outer shell of the ink cartridge.

FIGS. 3 through 5 illustrate an example of an outer shell construction of the ink cartridge (main tank) to be used with the ink-jet recording apparatuses constructed above.

FIG. 3 shows the overall construction of a lower case which constitutes the outer shell of the main tank. This lower case 41 is formed in a flattened box-shaped form. The upper surface of the lower case 41 is opened, and an ink pack 24 filled with ink is housed in the lower case 41.

Figure 5A:
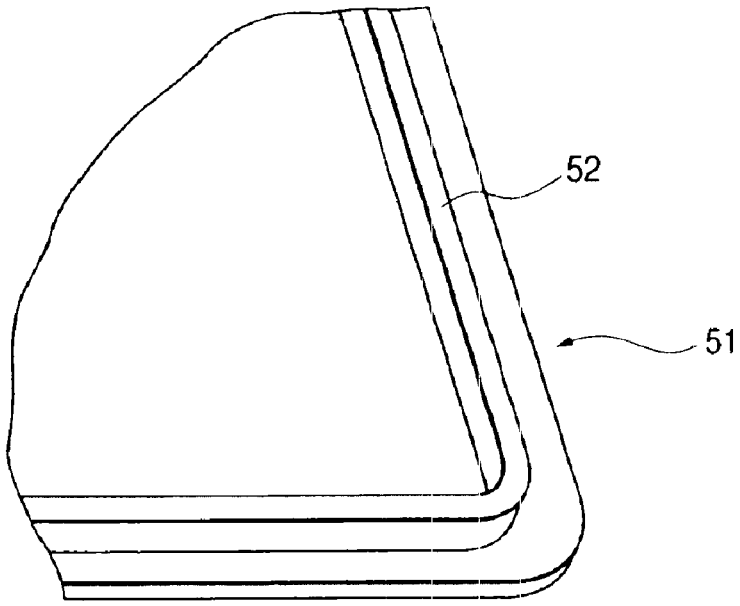
FIG. 5A is an enlarged view of the corner designated by A shown in FIG. 4.
Figure 5B:
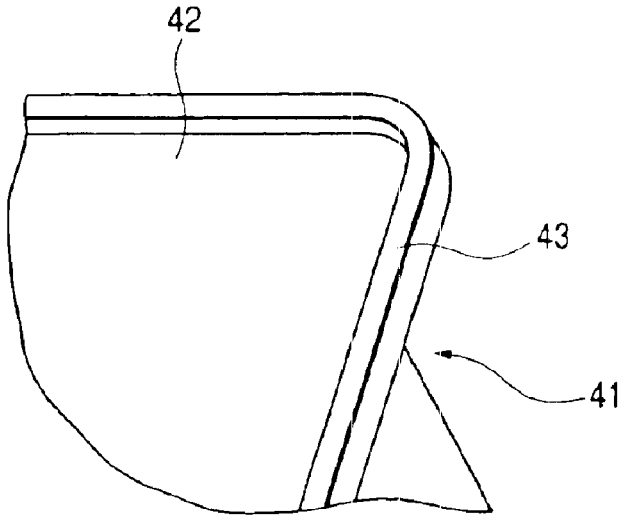
FIG. 5B is an enlarged view of the corner designated by B shown in FIG. 3.

A continuous weld surface 42 is formed along the entirety of the peripheral edge of the lower case 41 so as to be located on a substantially-flat single imaginary plane. An upright flange section 43 is integrally formed on the peripheral edge of the lower case 41 along the outer periphery of the weld surface 42. FIG. 5B is an enlarged view of a corner section designated by B in FIG. 3.

As will be described later, the upright flange section 43 is formed to prevent splashing of particles, which would otherwise be caused when a director (material to be welded) formed on an upper case is scraped frictionally in a case where the upper case which acts as a second outer shell constituent member ls fixed to the lower case 41 shown in FIG. 3 by vibratory welding.

Grid-shaped reinforcement ribs 44 are formed on the bottom surface of the lower case 41, a surface of the lower case 41 used for defining the pressure chamber 25, to prevent deformation of the lower case 41 caused by air pressure. In a case where the lower case 41 is formed by, for example, injection molding, the reinforcement ribs 44 are formed integrally and simultaneously with the lower case 41. As will be described later, the upper case is hermetically attached to the lower case 41 to define an internal pressure chamber. In this case, the grid-shaped reinforcement ribs 44 prevent occurrence of deformation, which would otherwise be caused in the direction orthogonal to the surface of the lower case 41 by the air pressure applied to the internal pressure chamber.

In other words, forming the grid-shaped reinforcement ribs 44 in the manner as mentioned above enables an increase in the strength of the lower case 41 in the direction orthogonal to the surface of the lower case 41. Hence, the present embodiment can also contribute to a reduction in the amount of synthetic resin used for forming a lower case.

In this case, even when the reinforcement ribs 44 are formed on the exterior of the lower case 41, the same reinforcing effects are obtained. In a case where the grid-shaped ribs 44 shown in FIG. 3 are formed on the exterior of the lower case 41, it is difficult to affix on a cartridge a label with a mark showing the trade name or identification of the cartridge. For this reason, forming the ribs 44 on the bottom surface of the lower case 41 in the manner as shown in FIG. 3 is desirable.

As shown in FIG. 3, a pair of guide holes 45 are formed on a longitudinal end of the lower case 41. In a case where the outer shell of an ink cartridge is constituted by the lower case 41 in conjunction with the upper case to be described later, the guide holes 45 are fitted to and positioned by a pair of guide pins provided on the cartridge holder of the recording apparatus.

Next, FIG. 4 shows the overall construction of the upper case constituting the outer shell of the main tank as viewed from its inner surface side. This upper case 51 is formed into a flattened box-shaped form, with the center thereof being recessed slightly. The upper case 51 is constructed so as to act as a cover of the lower case 41.

A continuous director (e.g., material to be welded) 52 which is to be frictionally welded upon contact with the weld surface 42 is formed along the periphery of the upper case 51, so as to be located on a substantially-flat single imaginary plane. FIG. 5A shows an enlarged view of the corner section designated by A shown in FIG. 4.

As in the case of the lower case 41, grid-shaped reinforcement ribs 53 are formed on the ceiling lower surface of the upper case 51, i.e. the surface of the upper case 51 defining the pressure chamber 25, to prevent deformation of the surface of the upper case 51, which would otherwise be caused by air pressure. In a case where the upper case 51 is formed by, for example, injection molding, the reinforcement ribs 53 are formed integrally and simultaneously with the upper case 51. In a case where the upper case 51 is hermetically attached to the lower case 41, thereby constituting the internal pressure chamber, the grid-shaped reinforcement ribs 53 prevent deformation, which would otherwise arise in the direction orthogonal to the surface of the upper case 51 by the air pressure applied to the internal pressure chamber.

As mentioned above, even in the case of the upper case 51, the reinforcement ribs 53 are formed on the ceiling lower surface (i.e. an internal surface) of the upper case 51, thus giving consideration to preventing difficulty in affixing on the surface of a cartridge a label of mark representing the trade name or identification of the cartridge.

The ink pack 24 preliminarily filled with ink is housed in the lower case 41, and the upper case 51 is then joined to the lower case 41 by the vibration welding, thereby obtaining a final product of the ink cartridge.

Figure 6:
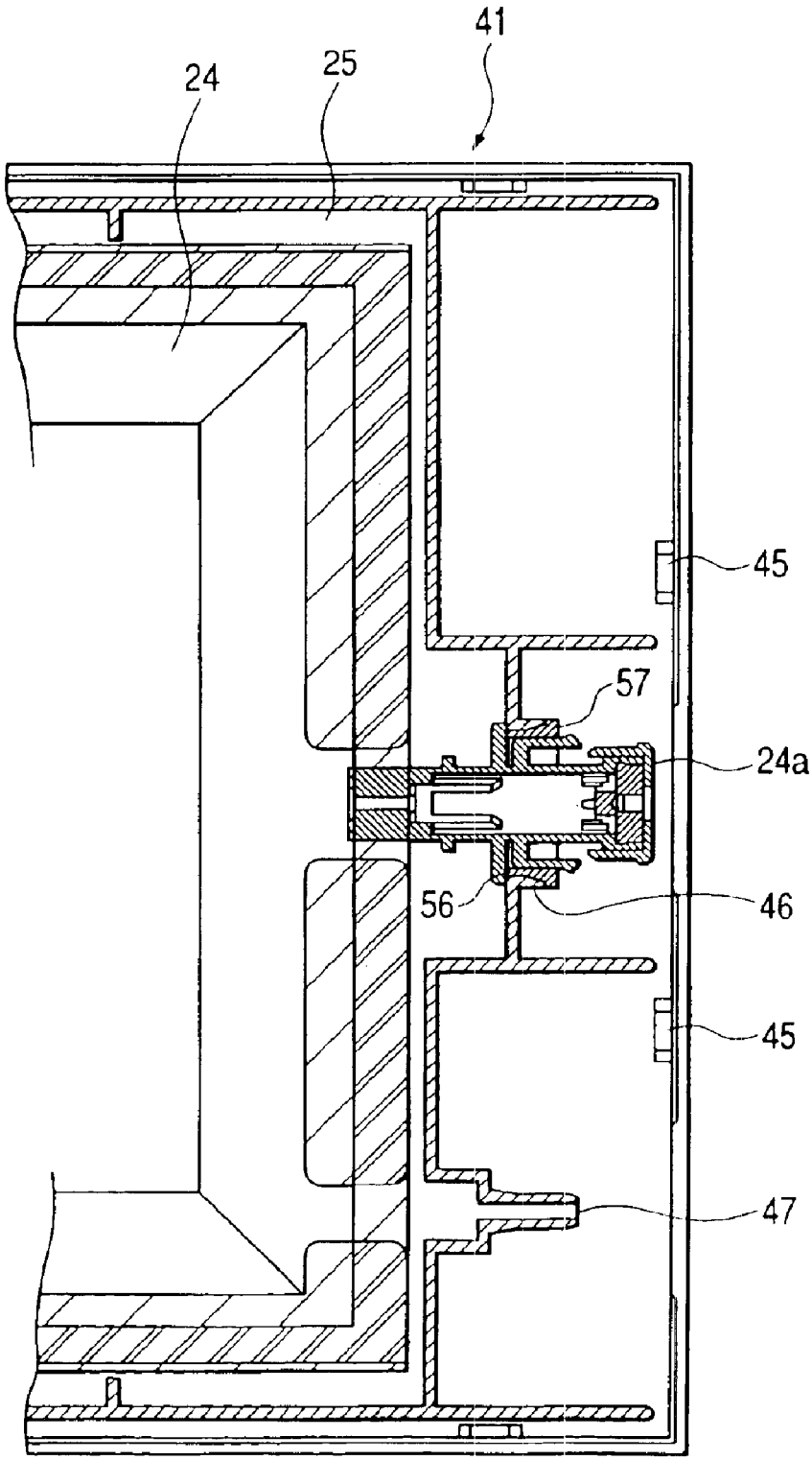
FIG. 6 is a cross-sectional view showing an ink cartridge in the assembled state.

FIG. 6 is a cross-sectional view showing an ink outlet portion in the final product of the ink cartridge. With reference to FIG. 6, an assembly process for the ink cartridge will be described.

First, the ink pack 24 which has been filled with ink preliminarily is housed in the lower case 41. In this case, a plug member 24*a* which seals the ink pack 24 and constitutes an ink outlet port is exposed outside the lower case 41 by way of an opening section 46 formed in the side end section of the lower case 41.

In this state, an O-ring 56 is abuttingly provided to the opening section 46, and an annular engagement member 57 is pushed and fitted to the opening section 46 from the outside of the lower case 41, so that the plug member 24*a* of the ink pack 24 can be attached to the opening section 46 of the lower case 41.

As mentioned above, the plug member 24*a* of the ink pack 24 is attached to the lower case 41 such that the annular engagement member 57 compresses the O-ring 56 fitted to the opening 46. Hence, the space between the opening section 46 formed in the lower case 41 and the plug member 24*a* of the ink pack 24 is sealed hermetically.

After the ink pack 24 has been installed in the interior of the lower case 41 in this way, the upper case 51 is laid on the lower case 41, and the cases 41 and 51 are joined by vibratory welding. When the cases 41 and 51 are joined by vibratory welding, the peripheral edge of the lower case 41 is supported from below by an unillustrated vibratory welding jig, and the upper case 51 is placed so that the director 52 of the upper case 51 is contacted with the weld surface 42 of the lower case 41.

The peripheral edge of the upper case 51 is pressed from above by unillustrated another vibratory welding jig, and the vibratory welding jig pressing the upper case 41 operates so as to apply load to the upper case 51 in the direction of gravity and horizontal vibration to the same.

The director 52 formed on the upper case 51 is slid on the weld surface 42 of the lower case 41 while the load is applied to the director 52. By frictional heat developing between the director 52 and the weld surface 42, a portion of the director 52 formed on the upper case 51 and a portion of the weld surface 42 formed on the lower case 41 are fused.

While application of load to the upper case 51 is maintained, horizontal vibratory movement of the movable vibratory welding jig is stopped, so that the upper case 51 is hermetically joined to the lower case 41.

The outer shell which is constructed in the manner as mentioned above and serves as an ink cartridge is hermetically formed, by fused resin of the upper and lower cases 51 and 41. Accordingly, the outer shell can be preferably adopted for use with an ink-jet recording apparatus constructed so as to introduce air pressure into main tanks serving as ink cartridges as described above. In addition, reference numeral 47 in FIG. 6 designates an air introducing port to which pressurized air generated by pressurizing pump is supplied.

Figure 7:
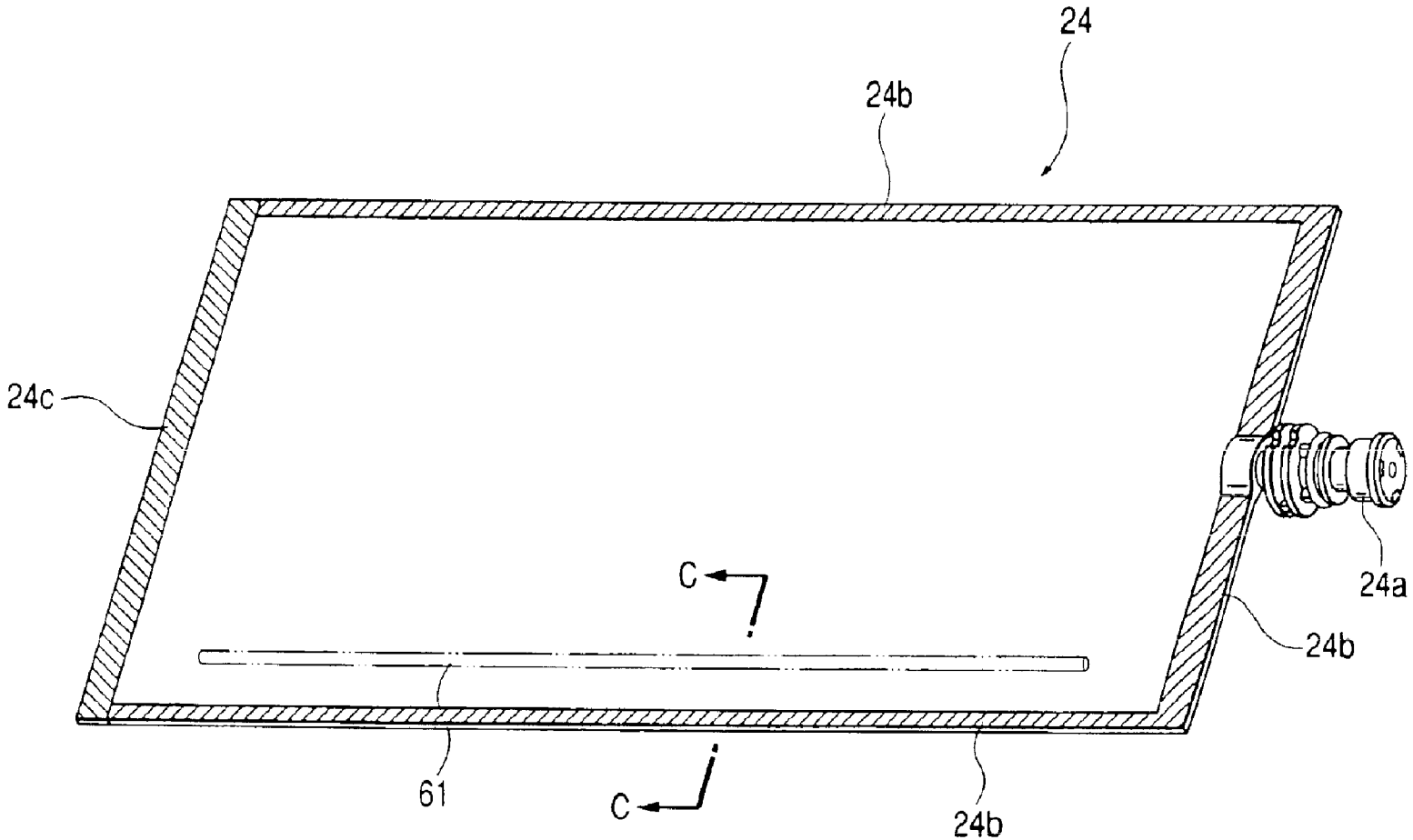
FIG. 7 is a perspective view showing the appearance and construction of an ink pack to be housed in the cartridge according to the first aspect of the present invention.

FIG. 7 shows the structure of the ink pack 24 which is housed in the outer shell case constructed in the manner as mentioned above, and which is used in an ink cartridge according to the first aspect of the present invention.

Two sheets of rectangular flexible material; for example, polyethylene films, are used for the ink pack 24. In order to improve the gas-barrier characteristic of the ink pack 24, aluminum foil or the like, for example, is laminated on the surface of each film.

Three sides, i.e. the lateral side end section having the plug member 24*a* and the longitudinal side end sections orthogonal to the lateral side end section, are first joined by heat welding to form a bag. Reference numeral 24*b* designates a heat-welded section in each of the three sides.

Ink is filled into the ink pack 24 from the remaining one open side of the ink pack 24 formed into the bag. The remaining side is then joined by heat welding to provide the ink pack 24 sealing storing ink therein. Reference numeral 24*c* designates a heat-welded section in the remaining side.

As shown in FIG. 7, a contact prevention member 61 formed from genuine or pure material is provided within the ink pack 24 for preventing interior surfaces of the ink pack 24 from being closely contacted with each other.

In the embodiment shown in FIG. 7, the contact prevention member 61 is formed from a single rod member. A metal rod member; for example, piano wire, or a so-called wire, can be utilized for the contact prevention member 61.

The contact prevention member 61 is fixed beforehand on the interior surface of one of the sheets constituting the ink pack 24, by heat-welding. More specifically, the contact prevention member 61 is held on the interior surface of the ink pack 24 by the heat-welding used for forming the ink pack 24.

When the ink cartridge is loaded in the recording apparatus of FIG. 1A such that the surfaces of the flattened ink pack 24 are oriented in the vertical direction, the contact prevention member 61 is situated in a lower position within the ink pack 24 with respect to the direction of gravity.

When ink is sequentially supplied to the sub-tanks 7 as a result of consumption of ink and when the amount of ink remaining in the ink pack 24 becomes small, the pressurized air acts on the ink pack 24 so as to make the interior surfaces of the ink pack 24 into close contact with each other.

In this case, since the contact prevention member 61 is housed in the ink pack 24 for preventing close contact between the interior surfaces of the ink pack 24, the presence of the contact prevention member 61 prevents a problem of, for example, clogging in the center portions of the ink pack 24, which would otherwise be caused when the center portions of the ink pack are brought into close contact with each other by the pressurized air acting on the ink pack.

Figure 9:
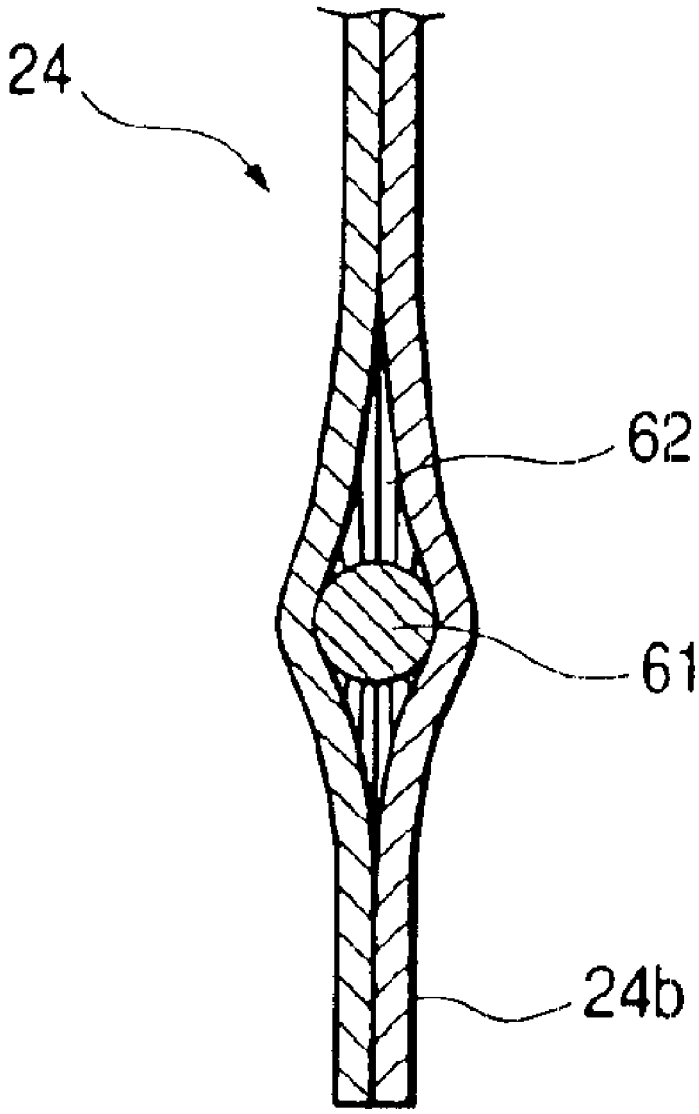
FIG. 9 is an enlarged cross-sectional view of the ink pack shown in FIGS. 7 and 8 taken along line C—C shown in FIGS. 7 and 8 as viewed in the direction designated by arrows.

FIG. 9 is an enlarged cross-sectional view showing a part of the ink pack 24, taken along line C—C shown in FIG. 7 as viewed in the direction designated by arrows, in a state in which the remaining ink amount is small.

As shown in FIG. 9, when the amount of ink remaining in the ink pack has diminished, an air gap is formed in the area around the contact prevention member 61. An ink flow passage 62 is formed along the contact prevention member 61 by this air gap.

In the embodiment shown in FIG. 7, the contact prevention member 61 is laid in the longitudinal direction of the ink pack 24. Ink remaining in various locations in the ink pack 24 can be guided to the ink outlet plug member 24*a* by way of the ink flow passage 62 extending along the contact prevention member 61.

The ink cartridge is loaded in the recording apparatus such that the surfaces of the ink pack 24 are oriented in the vertical direction, and the contact prevention member 61 is provided so as to be situated in a lower position within the ink pack 24 with respect to the direction of gravity. Hence, the ink remaining in the ink pack 24 gathers around the contact prevention member 61 under gravity. As mentioned above, the remaining ink is guided to the ink outlet plug member 24*a* by way of the ink flow passage 62 extending along the contact prevention member 61. Consequently, the efficiency of use of ink stored in an ink cartridge can be improved further.

Figure 8:
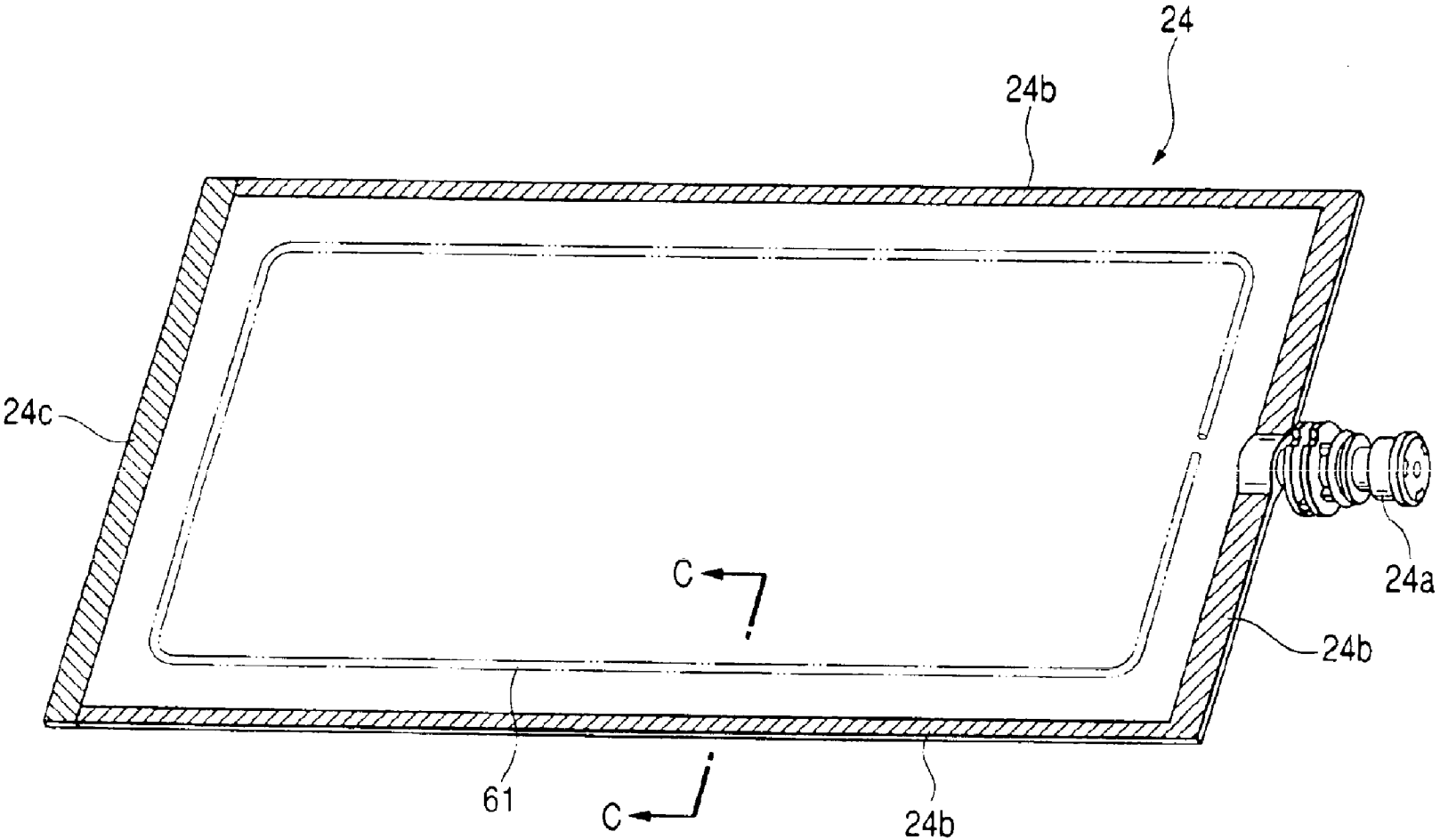
FIG. 8 is a perspective view showing another embodiment of an ink pack according to the first aspect of the present invention.

FIG. 8 shows another embodiment of the ink pack according to the first aspect of the present invention. The ink pack shown in FIG. 8 is constructed such that a single rod member bent into a substantially rectangular shape is accommodated within the ink pack 24 along the four sides thereof to serve as the contact prevention member 61.

The ink pack of this construction is formed in the following manner. One lateral side, in which the plug member 24*a* is provided, and the two longitudinal sides are bonded by heat welding to constitute a bag shape. Then, the rectangular contact prevention member 61 is inserted into the bag-shaped ink pack through one open side. Simultaneously, ink is filled into the ink pack 24, and finally, the remaining side is bonded by heat welding.

The construction shown in FIG. 8 eliminates a necessity of managing the front and reverse sides of the ink pack 24 during the course of housing the ink pack 24 into the ink cartridge. As in the previous case, ink remaining in the ink pack 24 can gather in the vicinity of the contact prevention member 61 under gravity.

Consequently, the cross-section of the ink pack shown in FIG. 8 taken along line C—C as viewed in the direction designated by arrows becomes identical with that shown in FIG. 9, thus further improving the efficiency of use of ink stored in an ink cartridge.

As is evident from the descriptions thus far, in the ink cartridge for use with a recording apparatus according to the first aspect of the present invention, the contact prevention member 61 is accommodated in the ink pack 24, which is formed into a flattened bag shape from flexible material, for preventing close contact between interior surfaces of the ink pack 24 caused due to reduction in the amount of ink stored. Hence, ink remaining in the ink pack 24 can be efficiently guided to the ink outlet plug section 24*a* via the ink flow passage extending along the contact prevention member.

Particularly, in a cartridge of the type in which an ink pack receives pressurized air introduced into an outer shell case, an ink flow passage can be effectively ensured by the contact prevention member, thus contributing to improvement in the efficiency of use of ink. Further, since the pure or genuine material is used as the contact prevention member, the efficiency of the use of ink can be further improved.

Next, an ink cartridge for use with a recording apparatus according to a second aspect of the present invention will be described. The ink cartridge according to the second aspect is loaded, for example, to the recording apparatus, which has been described with reference to FIG. 1B, in a vertical state, to provide remarkable effect.

Figure 10:
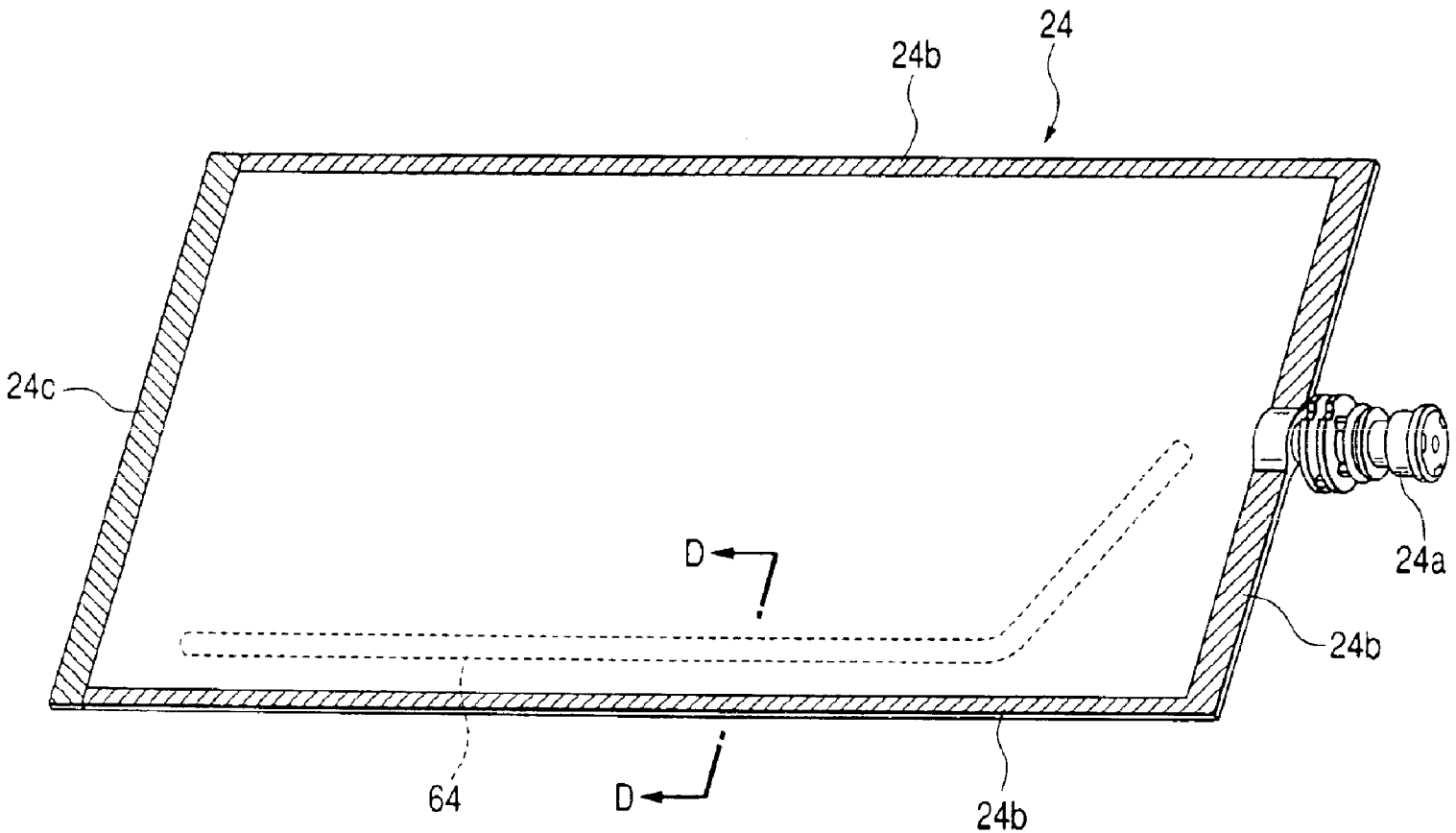
FIG. 10 is a perspective view of an ink pack to be housed in the cartridge according to the second aspect of the present invention.
Figure 11:
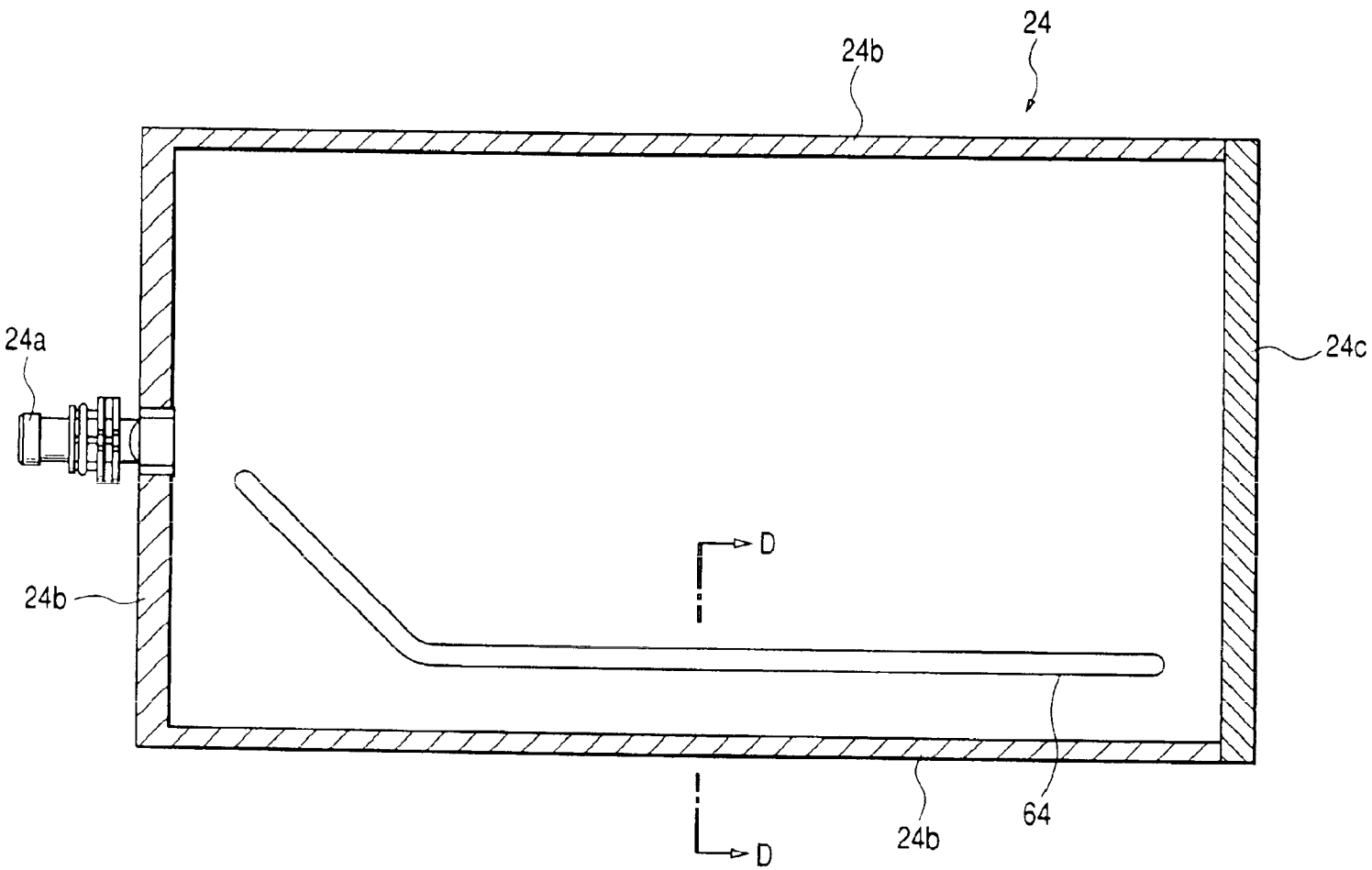
FIG. 11 is a rear view of the ink pack shown in FIG. 10.
Figure 12:
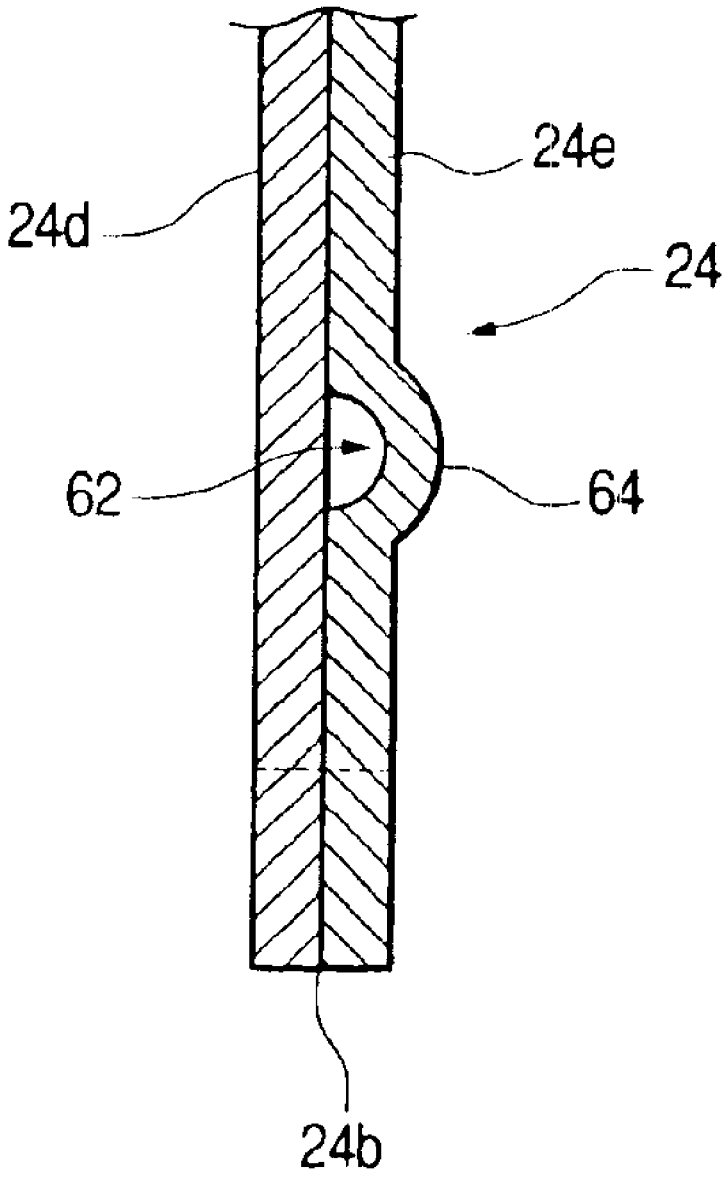
FIG. 12 is an enlarged cross-sectional view of the ink pack shown in FIGS. 10 and 11 taken along line D—D shown in FIGS. 10 and 11 as viewed in the direction designated by arrows.

FIGS. 10 through 12 show a first embodiment of an ink pack to be used in an ink cartridge according to the second aspect of the present invention. This ink pack is to be housed in an outer shell case similarly to the aforementioned ink pack of the first aspect.

FIG. 10 is a perspective view showing the ink pack 24 as viewed from one surface thereof. FIG. 11 is a rear view of the ink pack 24 as viewed from the reverse surface thereof. FIG. 12 is an enlarged cross-sectional view taken along line D—D shown in FIGS. 10 and 11 as viewed in the direction designated by arrows.

The ink pack 24 is also constructed in the same manner as the ink pack 24 used with the ink cartridge described in connection with the first aspect. Corresponding portions of the ink packs 24 are assigned the same reference numerals.

As shown in FIGS. 10 through 12, a bulging section 64 is formed on one of two flexible material sheets constituting the ink pack 23; that is, a flexible material sheet designated by 24*e* shown in FIG. 12. More specifically, the bulging section 64 bulging toward the exterior surface is arranged so as to continuously extend along the lower side of the ink pack in the gravity direction when the surface direction of the flattened ink pack is oriented substantially in the vertical direction.

The bulging section 64 is formed on the material sheet 24*e* by press-molding before the ink pack 24 is bonded by heat-welding to form a bag. In the present embodiment, the bulging section 64 is formed on only one flexible material sheet 24*e*, as shown in FIG. 12. However, another bulging section may be formed on the other flexible material sheet 24*d* in the same manner, so as to oppose the bulging section 64 formed on the material sheet 24*d*.

Since the ink pack 24 is subjected to a pressurized state under the pressure of the pressurized air as described above, when the ink pack 24 becomes close to an ink end (empty) state, the ink pack 24 receives air pressure, so that the two flexible material sheets 24*d* and 24*e* constituting the ink pack 24 are brought into close contact with each other as shown in FIG. 2.

However, presence of the bulging section 64 thus formed constitutes the ink flow passage 62 along the interior surface of the ink pack 24. Ink remaining in the ink pack 24 gathers along and into the ink flow passage 62 formed along the bulging sections 64 by the action of the gravity.

Further, in the embodiment shown in FIGS. 10 and 11, the ink flow passage 62 formed along the lower side of the ink pack in the gravity direction is elongated to the vicinity of the plug member 24*a*, serving as the ink outlet port, disposed at substantially the central portion of the ink pack end section. Accordingly, the remaining ink gathering around the ink flow passage 62 is guided to the outlet port via the ink flow passage 62.

Consequently, the majority of the ink remaining in the ink pack 24 can be guided to the recording apparatus side by the air pressure, with a nominal amount of ink remaining in the ink flow passage 62, thus improving the efficiency of use of ink.

Figure 13:
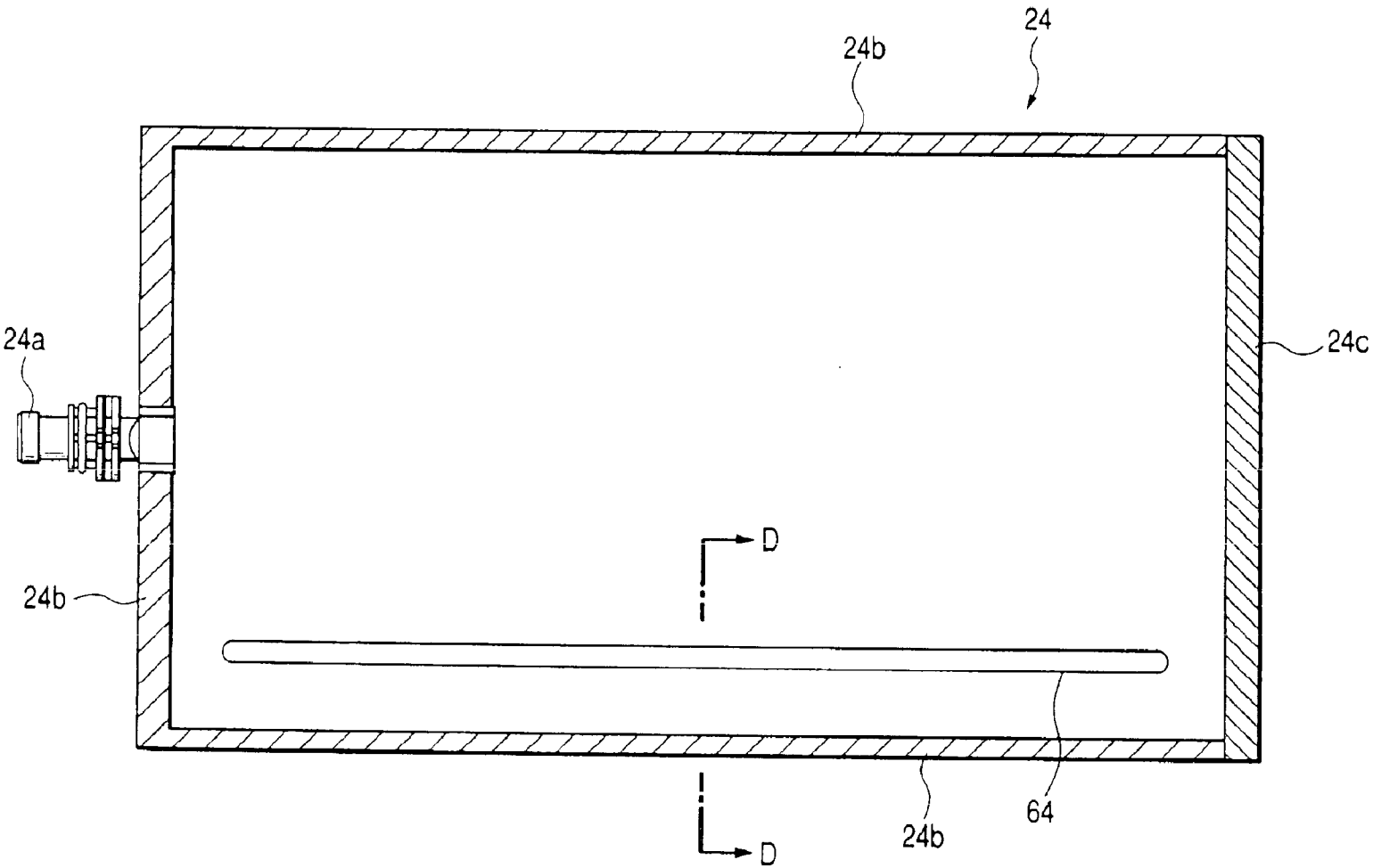
FIG. 13 is a rear view of another embodiment of an ink pack according to the second aspect of the present invention.

Next, FIG. 13 shows a second embodiment of an ink pack according to the second aspect of the present invention. Similarly to FIG. 11, FIG. 13 shows the ink pack 24 as viewed from the reverse surface side, and portions corresponding to those which have been already described are denoted by the same reference numerals.

The cross-section of the ink pack 24 taken along line D—D of FIG. 13 and viewed in the arrow direction is the same as that shown in FIG. 12. A structural difference of this embodiment from that shown in FIGS. 10 and 11 is that the ink flow passage 62 formed by the bulging portion 64 on the inner surface of the ink pack extends substantially linearly along the lower side in the gravity direction.

Even in the case where the ink flow passage 62 is formed to extend linearly along the lower side of the gravity direction, a portion where the plug member 24*a* is sealed as the ink outlet port forms a void space physically, and thus the surfaces of the ink pack in the area around the outlet port is unlikely contacted with each other by the air pressure.

For this reason, ink in the ink pack close to the ink end state can be guided to the vicinity of the outlet port via the ink flow passage 62 formed by the linear bulging portion 64, and then supplied via the plug member 24*a*, i.e. the ink outlet portion, to the recording apparatus side.

As is obvious from the above descriptions, in the ink cartridge for use with a recording apparatus according to the second aspect of the present invention, an ink pack which is formed from flexible material and into a flattened bag shape is housed in a case constituting the outer shell of the cartridge. The ink cartridge is loaded into the recording apparatus such that surfaces of the ink pack are oriented in substantially a vertical direction.

An ink flow passage bulging outwardly of the ink pack is formed on at least one of flexible material sheets constituting the ink pack, to extend along the ink pack lower side of the gravity direction. Hence, when the ink cartridge is close to the ink end state, residual ink is guided into the ink flow passage by the action of gravity.

Accordingly, the residual ink gathering in the vicinity of the ink flow passage can be efficiently guided to the outlet port, thus further improving the efficiency of use of ink stored in the cartridge.

Next, an ink cartridge for use with a recording apparatus according to a third aspect of the present invention will be described. The ink cartridge according to the third aspect is loaded, for example, to the recording apparatus discussed with reference to FIG. 1C, in a horizontal state, to provide remarkable effect.

Figure 14:
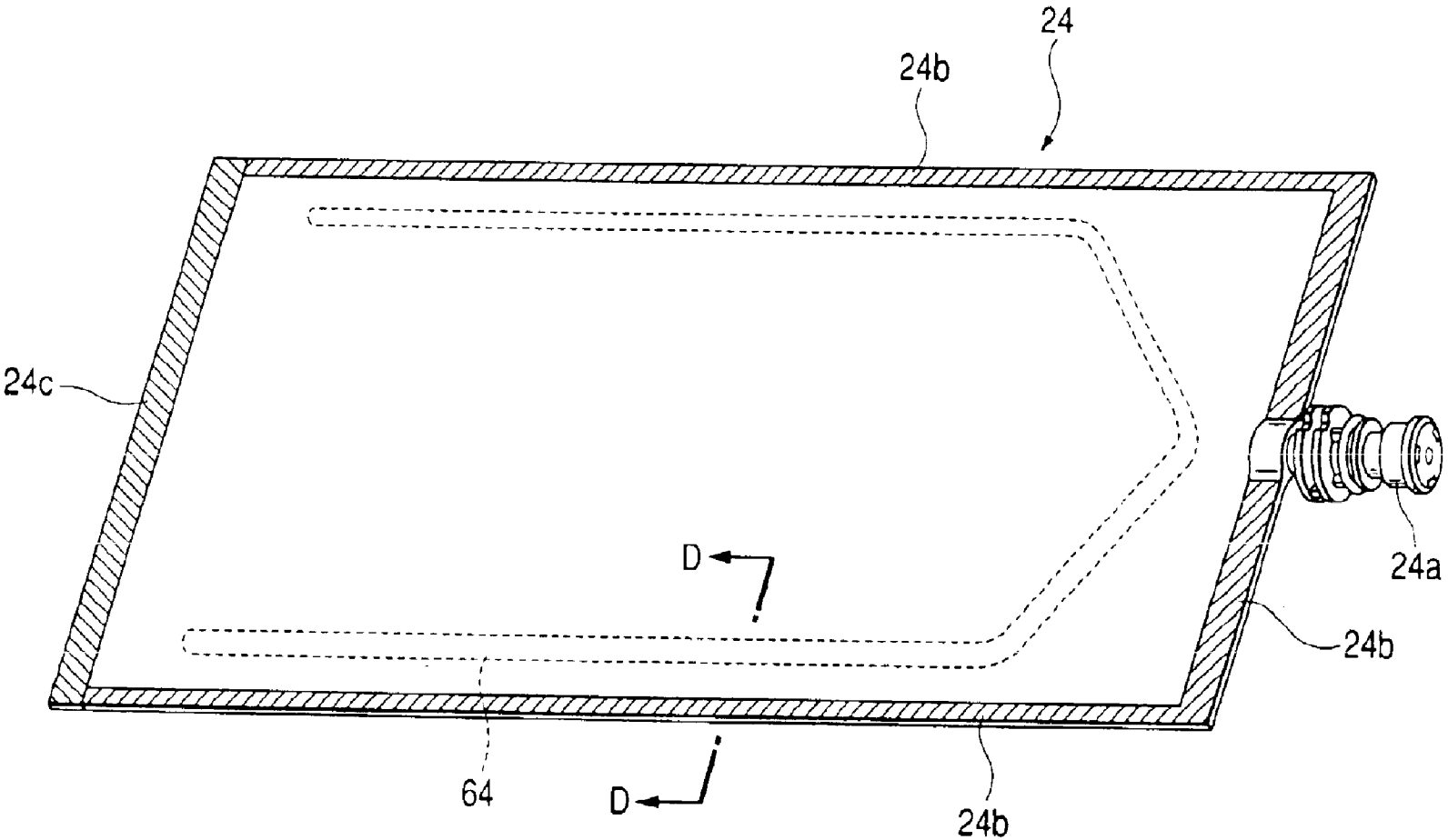
FIG. 14 is a perspective view of an ink pack to be housed in the cartridge according to a third aspect of the present invention.
Figure 15:
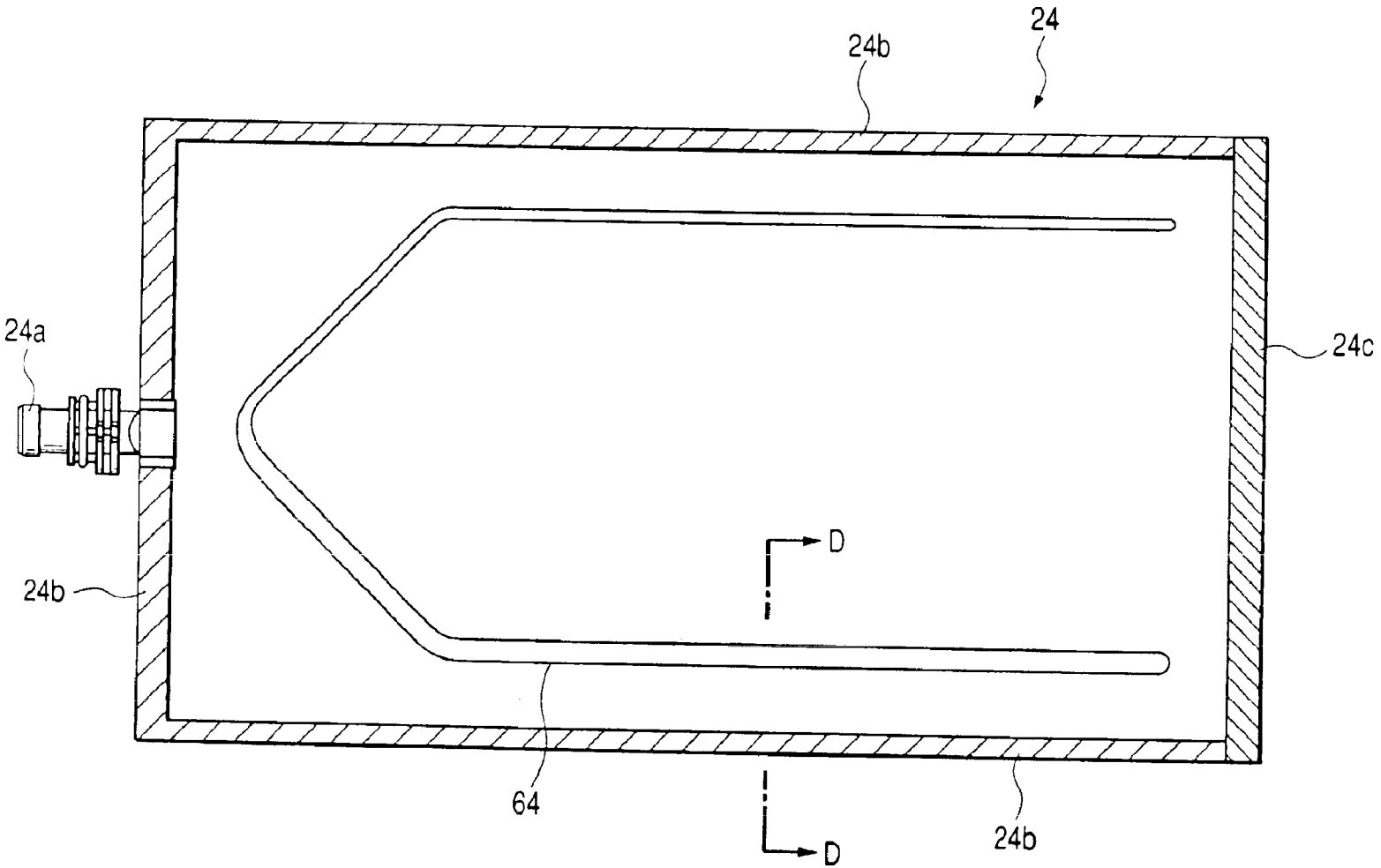
FIG. 15 is a rear view of the ink pack shown in FIG. 14.

FIGS. 14 through 15 show an ink pack to be used in the ink cartridge according to the third aspect of the present invention. The ink pack is to be housed in an outer shell case similarly to the ink cartridge of the first aspect.

FIG. 14 is a perspective view showing the ink pack 24 as viewed from one surface thereof. FIG. 15 is a rear view of the ink pack 24 as viewed from the reverse surface. This ink pack 24 is constructed similarly to the ink pack 24 used in the ink cartridge according to the first aspect, and portions corresponding to the portions which have been already described are denoted by the same reference numerals.

A cross-section of the ink pack used in the ink cartridge according to the third aspect, taken along line D—D of FIGS. 14 and 15 and viewed in the arrow direction is the same as that shown in FIG. 12. That is, a bulging section 64 is formed on one of flexible material sheets constituting the ink pack 24; that is, a flexible material sheet designated by 24*e*, to bulge outwardly.

As described in connection with the embodiment of the second aspect, the bulging section 64 is formed on the material sheet 24*e* by press-molding before the ink pack 24 is bonded by heat-welding to form a bag.

The embodiment of the third aspect is featured in that the bulging section 64 bulging toward the exterior surface is arranged so as to extend along the longitudinal sides perpendicular to the lateral side in which the plug member 24*a* is provided as an ink outlet port.

That is, as shown in FIGS. 14 and 15, portions of an ink flow passage 62 formed by the bulging section 64 respectively extend linearly along the longitudinal side edges of the ink pack 24. Further, the ends of portions of the ink flow passage 62 close to the ink outlet port are extended to the area in the vicinity of the ink outlet port, and communicated with each other to form a boomerang-shaped or V-shaped extended portion. Moreover, a bent, central part of the V-shaped extended portion is located in the vicinity of the plug member 24*a* forming the ink outlet port.

In this construction, since the ink pack 24 is subjected to a pressurized state under the pressure of the pressurized air, when the ink pack 24 becomes close to an ink end state, the ink pack 24 receives air pressure, so that the two flexible material sheets 24*d* and 24*e* constituting the ink pack 24 are brought into close contact with each other as shown in FIG. 12.

However, the presence of the bulging section 64 defines the ink flow passage 62 along the interior surface of the ink pack 24. Ink remaining in the ink pack 24 gathers along the ink flow passage (62) linear portions formed by the bulging section 64 along the longitudinal side edges of the ink pack 24.

Under the air pressure, the ink remaining in the ink pack 24 is guided, by way of the V-shaped ink flow passage portion, to be supplied from the plug member 24*a* constituting the ink outlet port to the recording apparatus.

Consequently, the majority of the ink remaining in the ink pack 24 can be guided to the recording apparatus by air pressure, with a nominal amount of ink remaining in the ink flow passage 62, thus improving the efficiency of use of ink.

In the embodiment shown in FIGS. 14 and 15, a pair of bulging section (64) portions are extended to be communicated with each other and to present a V-shaped form. A void space is physically formed in the area in which the plug member 24*a* serving as an ink outlet port is sealed. Hence, the area in the vicinity of the outlet port is unlikely brought into a contact state under air pressure.

For this reason, the V-shaped extended portion may be removed from the ink flow passage 62 formed from the pair of bulging sections (64) portions. That is, the ink flow passages 62 are provided independently of each other so as to linearly extend along the respective longitudinal sides of the ink pack 64. Even in this case, there can be expected substantially the same effects.

As is obvious from the above descriptions, in the ink cartridge for use with a recording apparatus according to the third aspect of the present invention, an ink pack which is formed from flexible material and into a flattened bag shape is housed in a case constituting the outer shell of the cartridge. The ink cartridge is loaded into the recording apparatus such that surfaces of the ink pack are oriented in substantially a horizontal direction.

Ink flow passages bulging outwardly of the ink pack are formed on at least one of flexible material sheets constituting the ink pack, along the respective longitudinal side edges perpendicular to the lateral side in which an ink outlet port is formed. Hence, when the ink cartridge is close to the ink end state, residual ink is guided to either of the ink flow passages.

Accordingly, the residual ink gathering in the vicinity of the ink flow passages can be efficiently guided to the outlet port, thus further improving the efficiency of use of ink stored in the cartridge.

What is claimed is:

1. An ink cartridge for use with a recording apparatus, comprising:

an ink pack which is filled with ink and is formed into a flattened bag shape from flexible material, wherein the flattened bag shape corresponds to a geometric shape and includes a heat-welded edge;

a case housing the ink pack and constituting an outer shell of the cartridge; and a contact prevention member which is provided within the ink pack for preventing close contact between interior surfaces of the ink pack, caused due to a reduction of ink in the ink pack, thereby ensuring an ink flow passage, wherein the contact prevention member is attached to the interior surface of the ink pack and is disposed at a location that is entirely separate from an inner-most edge of the heat welded edge of the ink pack corresponding to the geometric shape.

2. The ink cartridge according to claim 1, wherein the case is hermetically formed, and air pressure can be applied from a recording apparatus to an interior of the case to pressurize the ink pack when the ink cartridge is loaded to the recording apparatus.

3. The ink cartridge according to claim 1, wherein the contact prevention member is formed from genuine material.

4. The ink cartridge according to any one of claims 1 through 3, wherein the ink cartridge is loaded to the recording apparatus so that surfaces of the flattened ink pack are oriented in a vertical direction, and the contact prevention member is located at least partially in a lower position with respect to a direction of gravity.

5. The ink cartridge according to claim 4, wherein the contact prevention member is formed by a single rod member.

6. The ink cartridge according to claim 4, wherein the contact prevention member is formed by a single rod member bent into a substantially rectangular shape, and arranged the rod along four sides of the flattened ink pack.

7. The ink cartridge according to claim 1, wherein the contact prevention member has a circular cross-section.

8. The ink cartridge as claimed in claim 1, wherein the contact prevention member is entirely located within an inner space of the ink pack.

9. The ink cartridge as claimed in claim 8, wherein the contact prevention member is discrete from and does not form a portion of an outer surface of the ink pack.

10. An ink cartridge for use with a recording apparatus, comprising:

an ink pack which is filled with ink and is formed into a flattened bag shape from flexible material, wherein the flattened bag shape corresponds to a geometric shape;

a case housing the ink pack and constituting an outer shell of the cartridge; and a contact prevention member which is provided within the ink pack for preventing close contact between interior surfaces of the ink pack, caused due to a reduction of ink in the ink pack, thereby ensuring an ink flow passage, wherein the contact prevention member is attached to the interior surface of the ink pack and is disposed at a location that is separated from an outer edge of the ink pack corresponding to the geometric shape, wherein the case is hermetically formed, and air pressure can be applied from a recording apparatus to an interior of the case to pressurize the ink pack when the ink cartridge is loaded to the recording apparatus, wherein the ink cartridge is loaded to the recording apparatus so that surfaces of the flattened ink pack are oriented in a vertical direction, and the contact prevention member is located at least partially in a lower position with respect to a direction of gravity, wherein the contact prevention member is formed by a single rod member, and wherein the contact prevention member formed by the single rod member is fixed on one interior surface of flexible material constituting the ink pack, by heat welding.

11. An ink cartridge for use with a recording apparatus, comprising:

an ink pack which is filled with ink and is formed into a flattened bag shape from flexible material and includes a heat-welded edge;

a case housing the ink pack and constituting an outer shell of the cartridge;

wherein the ink cartridge is loaded to the recording apparatus so that surfaces of the flattened ink pack are oriented in a substantially vertical state, wherein an ink flow passage bulging outwardly of the ink pack is formed from at least one of interior surfaces of the flexible material constituting the ink pack to extend along a gravity direction lower side of the ink pack, wherein the ink flow passage is disposed at a location that is entirely separate from an inner-most edge of the heat-welded edge of the ink pack; and an ink outlet plug member provided at a side of the ink pack, wherein the side of the ink pack is substantially perpendicular to the gravity direction lower side of the ink pack.

12. The ink cartridge as claimed in claim 11, wherein the ink flow passage is integral with and defined by the at least one of the interior surfaces of the flexible material.

13. An ink cartridge for use with a recording apparatus, comprising:

an ink pack which is filled with ink and is formed into a flattened bag shape from flexible material and includes a heat-welded edge;

a case housing the ink pack and constituting an outer shell of the cartridge;

wherein the ink cartridge is loaded to the recording apparatus so that surfaces of the flattened ink pack are oriented in a substantially vertical state, wherein an ink flow passage bulging outwardly of the ink pack is formed on at least one of interior surfaces of flexible material constituting the ink pack to extend along a gravity direction lower side of the ink pack, wherein the ink flow passage is formed by press-forming flexible material constituting the ink pack, and wherein the ink flow passage is disposed at a location that is entirely separate from an inner-most edge of the heat-welded edge of the ink pack; and an ink outlet plug member provided at a side of the ink pack, wherein the side of the ink pack is substantially perpendicular to the gravity direction lower side of the ink pack.

14. The ink cartridge according to claim 11 or 13, wherein the case is formed hermetically, and air pressure can be applied from a recording apparatus to an interior of the case to pressurize the ink pack when the ink cartridge is loaded to the recording apparatus.

15. An ink cartridge for use with a recording apparatus, comprising:

an ink pack which is filled with ink and is formed into a flattened bag shape from flexible material and includes a heat-welded edge; and a case housing the ink pack and constituting an outer shell of the cartridge;

wherein the ink cartridge is loaded to the recording apparatus so that surfaces of the flattened ink pack are oriented in a substantially horizontal state, wherein ink flow passages bulging outwardly of the ink pack are formed from at least one of interior surfaces of the flexible material constituting the ink pack to extend along respective sides of the ink pack perpendicular to a side in which an ink outlet port is formed, and wherein each of the ink flow passages is entirely separate from an inner-most edge of the heat-welded edge of the ink pack.

16. An ink cartridge for use with a recording apparatus, comprising:

an ink pack which is filled with ink and is formed into a flattened bag shape from flexible material and includes a heat-welded edge; and a case housing the ink pack and constituting an outer shell of the cartridge;

wherein the ink cartridge is loaded to the recording apparatus so that surfaces of the flattened ink pack are oriented in a substantially horizontal state, wherein ink flow passages bulging outwardly of the ink pack are formed on at least one of interior surfaces of flexible material constituting the ink pack to extend along respective sides of the ink pack perpendicular to a side in which an ink outlet port is formed, wherein the ink flow passages are formed by press-forming flexible material constituting the ink pack, and wherein each of the ink flow passages is entirely separate from an inner-most edge of the heat-welded edge of the ink pack.

17. A flexible ink pack having opposing interior surfaces defining an ink storage chamber and including a heat-welded rectilinear edge, the flexible ink pack comprising:

a plug member provided to a shorter side of the ink storage chamber; and a protrusion and/or recess provided to at least one of the interior surfaces of the ink pack, and elongated substantially along a longer side of the ink storage chamber, wherein the protrusion and/or recess is provided to the interior surface of the ink storage chamber pack at a location that is entirely separate from an inner-most edge of the heat-welded rectilinear edge of the ink pack, and wherein the plug member allows ink to flow out of the ink storage chamber.

18. The flexible ink pack according to claim 17, wherein the protrusion includes a rod member attached to the one interior surface.

19. The flexible ink pack according to claim 17, wherein the protrusion is elongated linearly along the longer side.

20. The flexible ink pack according to claim 17, wherein the recess is elongated linearly along the longer side.

21. The flexible ink pack according to claim 17, wherein the protrusion is substantially rectangular.

22. The flexible ink pack according to claim 17, wherein the recess is substantially U-shaped.

23. The flexible ink pack according to claim 17, wherein the protrusion has an inclined portion angled with respect to both the shorter and longer sides.

24. The flexible ink pack according to claim 17, wherein the recess has an inclined portion angled with respect to both the shorter and longer sides.

25. A flexible ink pack having opposing interior surfaces defining a ink storage chamber and including a heat-welded rectilinear edge, the flexible ink pack comprising:

a plug member provided to a shorter side of the ink storage chamber; and a protrusion and/or recess provided to at least one of the interior surfaces of the ink pack, and elongated substantially along a longer side of the ink storage chamber and entirely separate from an inner-most edge of the heat-welded rectilinear edge of the ink pack, wherein the recess is formed as a consequence of plastically deforming a part of a flexible film defining the one interior surface, and wherein the plug member allows ink to flow out of the ink storage chamber.

26. An ink cartridge for use with a recording apparatus, comprising:

an ink pack which is filled with ink and is formed into a flattened bag shape from flexible material and including a heat-welded edge;

a case housing the ink pack and constituting an outer shell of the cartridge; and a contact prevention member which is provided within the ink pack for preventing close contact between interior surfaces of the ink pack, caused due to a reduction of ink in the ink pack, thereby ensuring an ink flow passage, wherein the contact prevention member is entirely located within an inner space of the ink pack, such that the contact prevention member is disposed at a location that is entirely separate from an inner-most edge of the heat welded edge of the ink pack.

27. The ink cartridge as claimed in claim 13, wherein the contact prevention member is discrete from and does not form a portion of an outer surface of the ink pack.

28. An ink cartridge for use with a recording apparatus, comprising:

an ink pack which is filled with ink and is formed into a flattened bag shape from flexible material, wherein the flattened bag shape corresponds to a geometric shape and includes a heat-welded edge;

a case housing the ink pack and constituting an outer shell of the cartridge;

wherein the ink pack has an integral portion for ensuring an ink flow passage when ink in the ink pack is reduced, and wherein the integral portion of the ink pack is disposed at a location that is entirely separate from an inner-most edge of the heat-welded edge of the ink pack corresponding to the geometric shape; and an ink outlet plug member provided at a side of the ink pack.

29. The ink cartridge as claimed in claim 28, wherein the side of the ink pack is substantially perpendicular to the gravity direction lower side of the ink pack.

30. An ink cartridge for use with a recording apparatus, comprising:

an ink pack which is filled with ink and is formed into a flattened bag shape from flexible material;

a case housing the ink pack and constituting an outer shell of the cartridge; and a contact prevention member which is provided within the ink pack for preventing close contact between interior surfaces of the ink pack, caused due to a reduction of ink in the ink pack, thereby ensuring an ink flow passage, wherein the contact prevention member is entirely located within an inner space of the ink pack, wherein the contact prevention member is discrete from and does not form a portion of an outer surface of the ink pack.

31. An ink cartridge for use with a recording apparatus, comprising:

an ink pack which is filled with ink and is formed into a flattened bag shape from flexible material;

a case housing the ink pack and constituting an outer shell of the cartridge; and a contact prevention member which is provided within the ink pack and which is attached to one interior surface of the ink pack and separates the one interior surface from other interior surfaces of the ink pack when the ink pack is filled with ink, wherein the contact prevention member contacts with the other interior surfaces of the ink pack for preventing close contact between interior surfaces of the ink pack, caused due to a reduction of ink in the ink pack, thereby ensuring an ink flow passage, wherein the contact prevention member is entirely located within an inner space of the ink pack, wherein the contact prevention member is discrete from and does not form a portion of an outer surface of the ink pack.

* * * * *